US011291991B2

(12) United States Patent
Chen

(10) Patent No.: US 11,291,991 B2
(45) Date of Patent: Apr. 5, 2022

(54) SAMPLE CARRIER DEVICE AND METHOD FOR OPERATING THE SAME

(71) Applicant: Materials Analysis Technology Inc., Hsinchu County (TW)

(72) Inventor: Hung-Jen Chen, Hsinchu (TW)

(73) Assignee: Materials Analysis Technology Inc., Hsinchu County (TW)

( * ) Notice: Subject to any disclaimer, the term of this patent is extended or adjusted under 35 U.S.C. 154(b) by 203 days.

(21) Appl. No.: 16/576,780

(22) Filed: Sep. 20, 2019

(65) Prior Publication Data

US 2020/0398271 A1 Dec. 24, 2020

(30) Foreign Application Priority Data

Jun. 18, 2019 (TW) ..... 108121063

(51) Int. Cl.
*B01L 3/00* (2006.01)

(52) U.S. Cl.
CPC ..... *B01L 3/5027* (2013.01); *B01L 2300/045* (2013.01); *B01L 2300/0672* (2013.01); *B01L 2300/08* (2013.01)

(58) Field of Classification Search
CPC ..... B01L 3/5027; B01L 2300/0672; B01L 2300/045; B01L 2300/08; B01L 2300/0681; B01L 2300/0645; B01L 2300/1827; B01L 2300/0896; B01L 2300/0887; B01L 3/502707; B01L 3/50; G01N 35/02; G01N 35/04; G01N 2223/418; G01N 23/2251; G01N 1/28; G01N 23/2204; G01N 23/02; G01N 33/543; H01J 49/0409; H01J 37/26; H01J 37/16; H01J 37/20; H01J 37/28
See application file for complete search history.

(56) References Cited

U.S. PATENT DOCUMENTS

2008/0135778 A1 6/2008 Liu et al.
2010/0181195 A1* 7/2010 Garcia Tello ..... B01L 3/50273 204/450

(Continued)

FOREIGN PATENT DOCUMENTS

CN 105489462 A 4/2016
JP 200816249 A 1/2008

(Continued)

*Primary Examiner* — Matthew D Krcha
*Assistant Examiner* — Sophia Y Lyle
(74) *Attorney, Agent, or Firm* — Li & Cai Intellectual Property Office

(57) ABSTRACT

A sample carrier device including a single substrate, a penetration structure and a fixing structure is provided. The penetration structure is formed on a side of the substrate. The penetration structure has a fluid passage. The fixing structure is formed on a side of the penetration structure. The sample carrier device is divided into an end portion, an observation portion and an operation portion. The user can separate the observation portion from the end portion by operating the operation portion. After the observation portion is separated from the end portion, the user can inject the sample into the fluid passage through a port of the fluid passage exposed to the observation portion. Once the sample is carried by the fluid passage of the observation portion, the user can seal the port of the fluid passage and place the observation portion in an electron microscope device.

8 Claims, 19 Drawing Sheets

(56) References Cited

U.S. PATENT DOCUMENTS

| | | | | |
|---|---|---|---|---|
| 2011/0006208 | A1* | 1/2011 | Freitag | G01N 23/2251 250/307 |
| 2012/0298883 | A1* | 11/2012 | Grogan | H01J 37/20 250/440.11 |
| 2013/0134039 | A1* | 5/2013 | Bjornson | B01L 3/505 204/451 |
| 2016/0377513 | A1* | 12/2016 | Chang | H01J 37/32009 250/428 |
| 2017/0032928 | A1* | 2/2017 | Mele | G01N 21/03 |
| 2017/0059522 | A1 | 3/2017 | Maebashi et al. | |
| 2017/0213692 | A1 | 7/2017 | Yu et al. | |
| 2018/0266989 | A1 | 9/2018 | Jungjohann et al. | |

FOREIGN PATENT DOCUMENTS

| | | | | |
|---|---|---|---|---|
| JP | 2016213148 | A | * | 12/2016 |
| JP | 2016213148 | A | | 12/2016 |
| TW | 201723457 | A | | 7/2017 |
| WO | WO2005124332 | A1 | | 12/2005 |

* cited by examiner

SAMPLE CARRIER DEVICE AND METHOD FOR OPERATING THE SAME

CROSS-REFERENCE TO RELATED PATENT APPLICATION

This application claims the benefit of priority to Taiwan Patent Application No. 108121063, filed on Jun. 18, 2019. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a sample carrier device and a method for operating the same, and more particularly to a sample carrier device capable of carrying a sample and capable of being placed under an electron microscope device to allow a user to observe the sample.

BACKGROUND OF THE DISCLOSURE

The way of use of a common electron microscope device, such as atomic force microscope (AFM), transmission electron microscope (TEM), scanning electron microscope (SEM), or the like, includes placing a sample on a sample holder, and then placing the sample holder into an electron microscope device, or directly placing the sample on an observation stage inside the electron microscope device. Since the sample holder or the observation stage cannot directly carry a liquid sample, users cannot observe the liquid sample directly by the electron microscope device, which can cause problems for the users.

SUMMARY OF THE DISCLOSURE

In response to the above-referenced technical inadequacies, the present disclosure provides a sample carrier device and a method for operating the same, which are mainly used for improving the problems that the common electron microscope device and related observation kits do not allow a user to observe liquid samples directly under the electron microscope device.

In one aspect, the present disclosure provides a sample carrier device for carrying a sample, and the sample carrier device includes a single substrate, at least one penetration structure and a fixing structure. Two opposite sides of the substrate are respectively defined as a first side and a second side, and the second side of the substrate is formed with a lower observation window penetrating the substrate. The penetration structure is formed on the first side of the substrate, and the penetration structure has at least one fluid passage. The lower observation window is configured to expose a part of the penetration structure outside the substrate, and the fluid passage is configured to receive a sample. The fixing structure is formed on a side of the penetration structure opposite to the substrate, and the fixing structure covers a portion of the penetration structure, in which a side of the fixing structure opposite to the substrate forms an upper observation window penetrating the fixing structure, and the upper observation window is configured to expose a part of the penetration structure outside the fixing structure. The sample carrier device is divided into at least one end portion, at least one operation portion, and an observation portion; the operation portion is located between the end portion and the observation portion, and the operation portion is capable of being operated such that the end portion and the observation portion are capable of being separated from each other; the upper observation window and the lower observation window are disposed corresponding to each other, and the upper observation window and the lower observation window are located at the observation portion; and the fluid passage spans across the end portion, the operation portion and the observation portion. When the operation portion is operated and the end portion is separated from the observation portion, a port of the fluid passage is exposed outside the observation portion, and the sample is capable of entering the fluid passage via the port. When the fluid passage located at the observation portion carries the sample and the port is sealed, the observation portion is capable of being placed into an electron microscope device.

In one aspect, the present disclosure further provides a method for operating the sample carrier device which includes the steps of: a disassembling step which includes: separating the end portion from the observation portion to expose two ports of the fluid passage located at the observation portion; a sampling step which includes: contacting one of the two ports with a sample such that the sample enters the fluid passage through the port; and a sealing step which includes: sealing the two ports to isolate the sample within the fluid passage from an external environment.

In one aspect, the present disclosure further provides a method for operating the sample carrier device which includes the steps of: a sampling step which includes: using an operation tool to pierce the penetration structure exposed through the through hole, such that the fluid passage spatially communicates with an external environment, and the sample is capable of entering the fluid passage through the through hole; a disassembling step which includes: separating the end portion from the observation portion to expose the two ports of the fluid passage located at the observation portion; and a sealing step which includes: sealing the two ports to isolate the sample within the fluid passage from an external environment.

Therefore, the sample carrier device of the present disclosure can greatly improve the production yield by forming a fluid passage on a single substrate, and the fluid passage can carry a liquid sample. Further, the sample carrier device can be directly fixed on a sample holder used in a common electron microscope device or an observation stage of the electron microscope device. Therefore, a user can use the sample carrier device to carry a liquid sample and directly observe the liquid sample under the electron microscope device.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
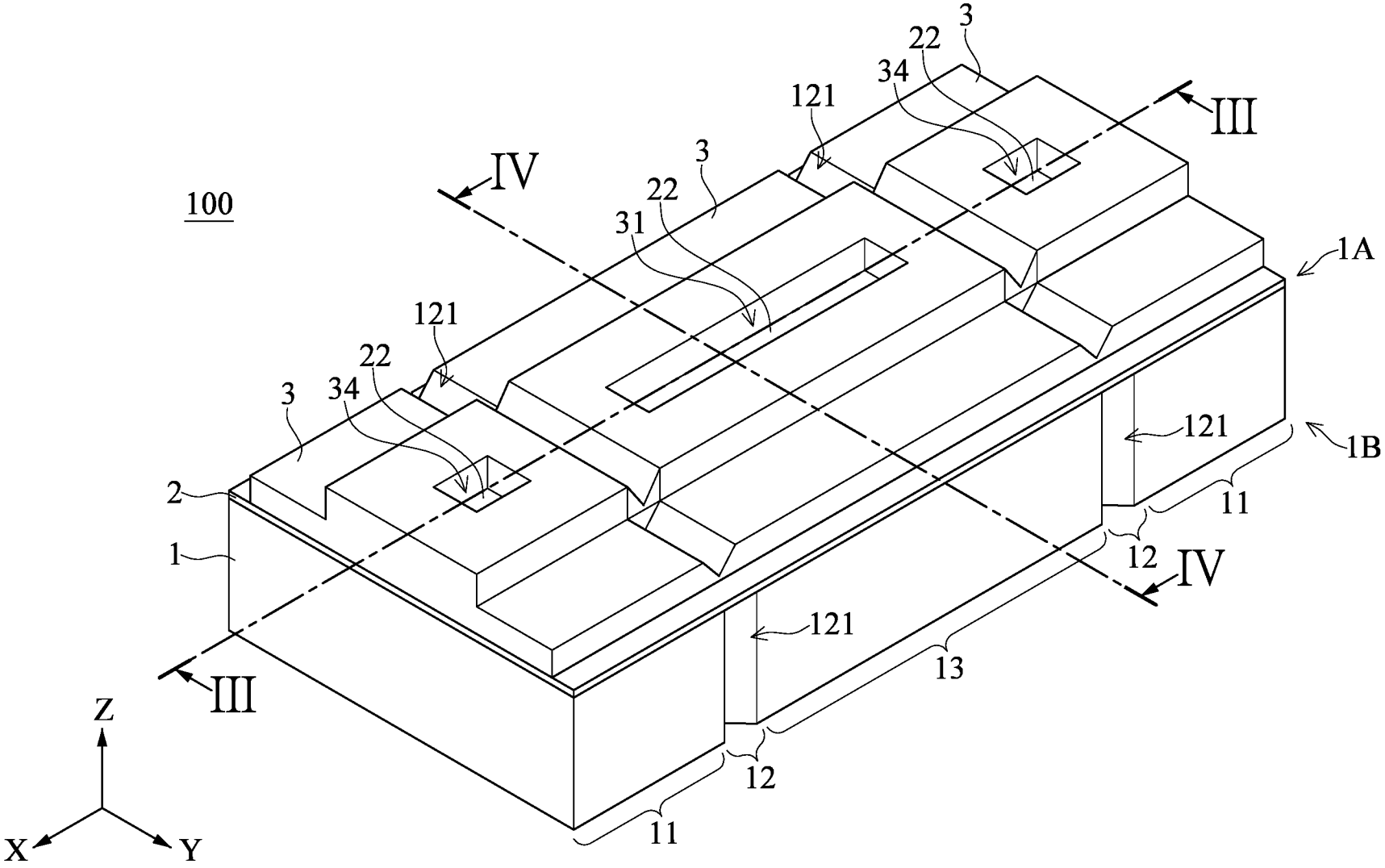
FIG. 1 is a perspective view showing a sample carrier device according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Figure 2:
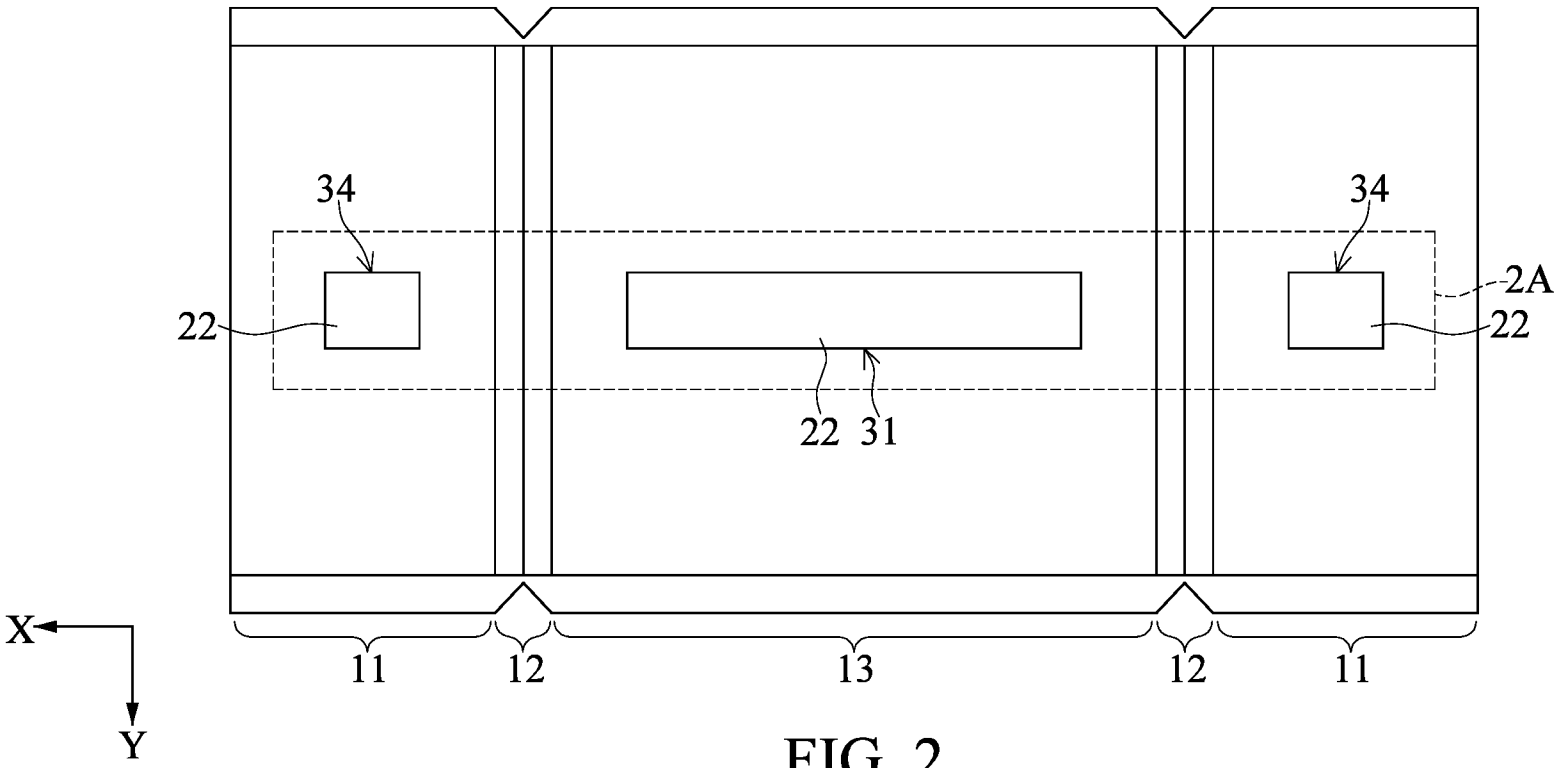
FIG. 2 is a top view of FIG. 1.
Figure 3:
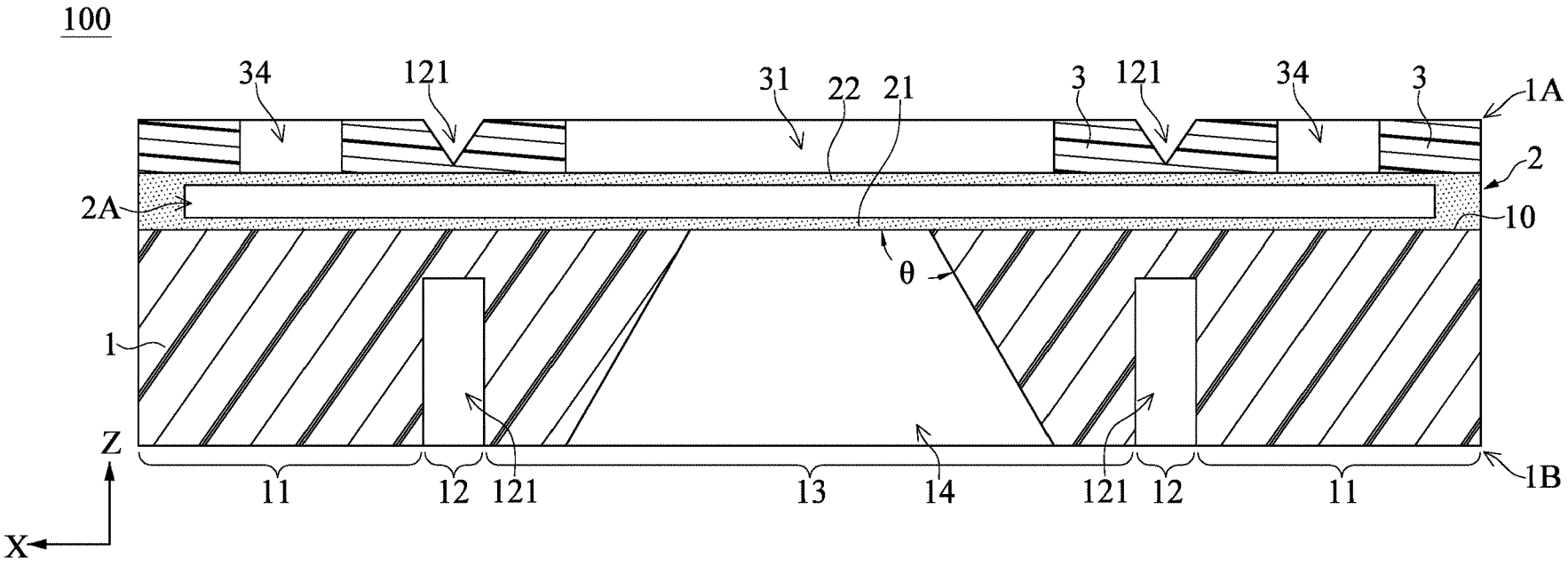
FIG. 3 is a cross-sectional view taken along line III-III of FIG. 1.
Figure 4:
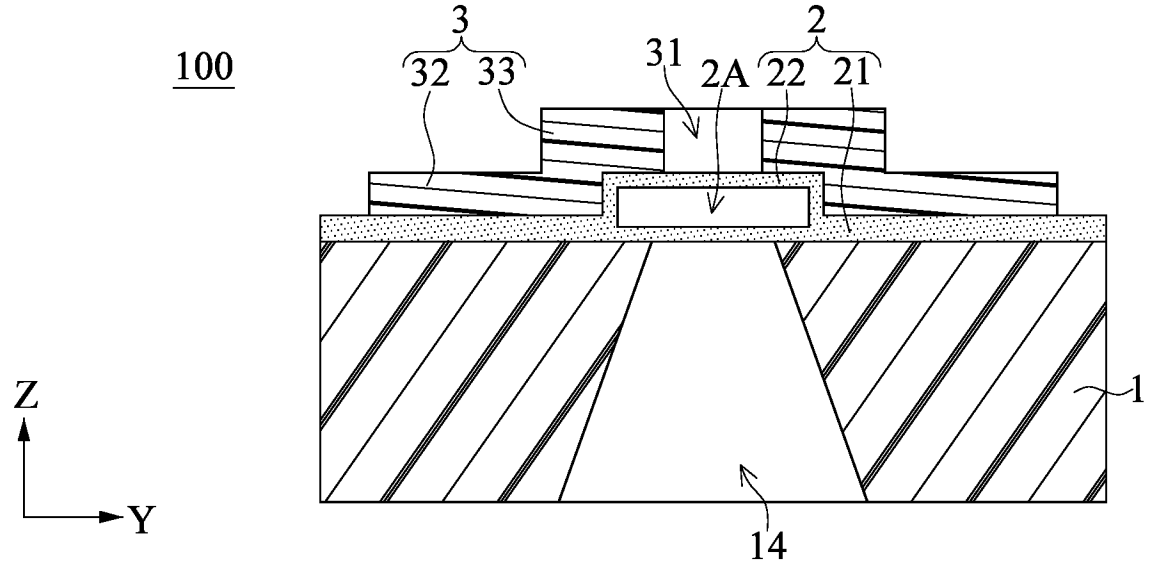
FIG. 4 is a cross-sectional view taken along line IV-IV of FIG. 1.

Referring to FIG. 1 to FIG. 4, FIG. 1 is a perspective view of a sample carrier device according to a first embodiment of the present disclosure, FIG. 2 is a top view of FIG. 1, FIG. 3 is a cross-sectional view taken along line III-III of FIG. 1, and FIG. 4 is a cross-sectional view taken along line IV-IV of FIG. 1.

Figure 9:
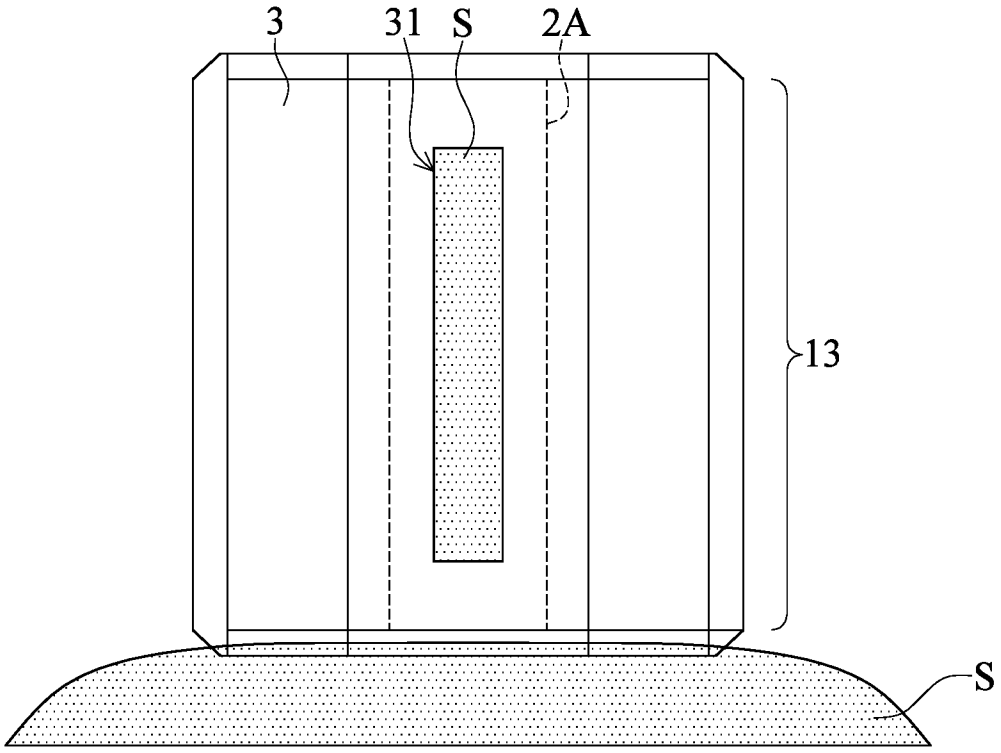
FIG. 9 is a schematic view showing the sample carrier device when absorbing a liquid sample.

The sample carrier device 100 is adapted to carry a sample S (as shown in FIG. 9). The sample carrier device 100 is used for being placed on a sample holder (sample holder) of an electron microscope device, and the electron microscope device allows a user to observe the sample S carried by the sample carrier device 100. The electron microscope device is, for example, an atomic force microscope (AFM), a transmission electron microscope (TEM), a scanning electron microscope (SEM), or the like, and the present disclosure is not limited thereto.

In practical applications, after carrying the sample S, the sample carrier device 100 is fixed to an adhesive and a copper ring, and then placed at a predetermined position on the sample holder. Since a liquid sample can be carried on the inside of the sample carrier device 100, users can use the electron microscope device to observe the liquid sample.

Generally, the sample to be tested is placed on a standard copper mesh (Cu Grid), and then fixedly disposed on the sample holder through a relevant fixing member. Since the standard copper mesh cannot carry a liquid sample, users cannot directly use an electron microscope device to observe the liquid sample. Accordingly, the sample carrier device 100 of the present disclosure provides a technical solution for a user to observe a liquid sample under an electron microscope device. The components included in the sample carrier device 100 of the present embodiment and their approximate manner of fabrication will be described in detail below.

The sample carrier device 100 of the present embodiment includes: a single substrate 1, at least one penetration structure 2 and a fixing structure 3. Two opposite sides of the substrate 1 are defined as a first side 1A and a second side 1B, respectively. The sample carrier device 100 can be divided into two end portions 11, two operation portions 12, and an observation portion 13. The observation portion 13 is located between the two end portions 11, one of the operation portions 12 is located between one of the end portions 11 and the observation portion 13, and the other one of the operation portions 12 is located between the other one of the end portions 11 and the observation portion 13. The operation portions 12 can be operated such that the end portions 11 are separated from the observation portion 13. In practice, the substrate 1 and the fixing structure 3 can form a plurality of notches 121 located at the operation portions 12, respectively. A user can apply an external force to the operation portions 12 of the sample carrier device 100 by an associated auxiliary tool to cause the sample carrier device 100 to be broken off from the operation portions 12, thereby separating the end portions 11 from the observation portion 13.

It should be noted that the substrate 1 and the fixing structure 3 are not limited to forming the notches 121 at the operation portions 12. The substrate 1 and the fixing structure 3 can also form a plurality of modified regions located at the operation portions 12, respectively. For example, the operation portions 12 of the substrate 1 can be modified by a technique such as stealth dicing to embrittle the material of the operation portions 12. Accordingly, when the operation portions 12 are subjected to an external force, the sample carrier device 100 can be easily broken off from the operation portions 12, and the end portions 11 can be easily separated from the observation portion 13. As described above, the function of the operation portions 12 is to allow a user to easily separate the end portions 11 from the observation portion 13. Therefore, in practice, the substrate 1 and the fixing structure 3 can form any structure at the operation portions 12, which facilitates the user to separate the end portions 11 from the observation portion 13, and the present disclosure is not limited to the above-mentioned notches or modified region.

The penetration structure 2 is formed on the first side 1A of the substrate 1. The inside of the penetration structure 2 has a fluid passage 2A for receiving the sample S. The fluid passage 2A spans across the end portions 11, the operation portions 12, and the observation portion 13. As shown in FIG. 3 and FIG. 4, the penetration structure 2 defines a first penetration structure 21 and a second penetration structure 22. The first penetration structure 21 is formed on a first surface 10 of the first side 1A of the substrate 1. The second penetration structure 22 is formed on a side of the first penetration structure 21 opposite to the first surface 10, and the second penetration structure 22 and a part of the first penetration structure 21 cooperatively form the fluid passage 2A.

In practice, the second penetration structure 22 includes a top wall 221 and two side walls 222, two opposite side edges of the top wall 221 each extend to form one of the side walls 222 along one direction, the two side walls 222 are disposed facing each other, and the top wall 221 and the two side walls 222 together form a structure substantially having an inverted U-shape. It should be noted that the shape of the second penetration structure 22 is not limited thereto and can be changed according to actual needs.

The second side 1B of the substrate 1 forms a lower observation window 14 penetrating the substrate 1, and the lower observation window 14 is configured to expose a part of the penetration structure 2 outside the substrate 1. The fixing structure 3 is formed on a side of the penetration structure 2 opposite to the substrate 1, and the fixing structure 3 covers a part of the penetration structure 2. The fixing structure 3 forms an upper observation window 31 penetrating fixing structure 3, and the upper observation window 31 is configured to expose a part of the penetration structure 2 outside the fixing structure 3. As shown in FIG. 4, the fixing structure 3 is formed on a side of second penetration structure 22 opposite to the substrate 1, and the fixing structure 3 is also formed on a side of a part of the first penetration structure 21 opposite to the substrate 1.

The penetration structure 2 and the fixing structure 3 can be sequentially formed on the first side 1A of the substrate 1 by a surface micromachining process. The surface micromachining process can be, for example, a semiconductor process, a microelectromechanical process (MEMS), or the like. In practice, the formation position, size, shape, and the like of the penetration structure 2 and the fixing structure 3 can be accurately controlled by using the surface micromachining process to form the penetration structure 2 and the fixing structure 3 on the first side 1A of the substrate 1.

The upper observation window 31 and the lower observation window 14 are disposed corresponding to each other, and the electron beam emitted from the electron microscope device can enter the fluid passage 2A through the upper observation window 31 and the lower observation window 14, and then pass through the sample S received in the fluid passage 2A. The shape and size of the upper observation window 31 and the lower observation window 14 can be changed according to actual need as long as the upper observation window 31 and the lower observation window 14 can provide the electron beam emitted from the electron microscope device to pass through.

As shown in FIG. 3, in the cross-sectional view of the sample carrier device 100, the lower observation window 14 has a trapezoidal shape, and the upper observation window 31 has a rectangular shape, but the present disclosure is not limited thereto. In practice, an angle θ between the side wall of the lower observation window 14 and the first penetration structure 21 shown in FIG. 3 can be between 80 degrees and 160 degrees. In various embodiments, the shape of the upper observation window 31 of the sample carrier device 100 can also have a trapezoidal shape.

Reference is made to FIG. 5A to FIG. 5G, which are schematic diagrams showing the manufacturing process of the sample carrier device according to the first embodiment of the present disclosure. In practice, the manufacturing process of the penetration structure 2 and the fixing structure 3 includes the following steps (steps 1 to 7).

Figure 5A:
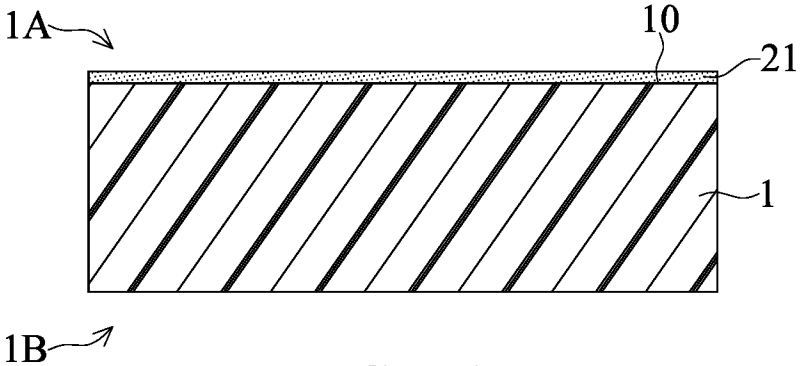
FIG. 5A to FIG. 5G are schematic diagrams showing a manufacturing process of the sample carrier device according to the first embodiment of the present disclosure.

As shown in FIG. 5A, the step 1 includes: forming a first penetration structure 21 on the first surface 10 of the first side 1A of the substrate 1. For example, the first penetration structure 21 can be formed by depositing a layer of tantalum nitride ($Si_3N_4$) on the first surface 10. The thickness of the substrate 1 can be 525 micrometers, and the thickness of the first penetration structure 21 can be between 25 nanometers and 100 nanometers.

Figure 5B:
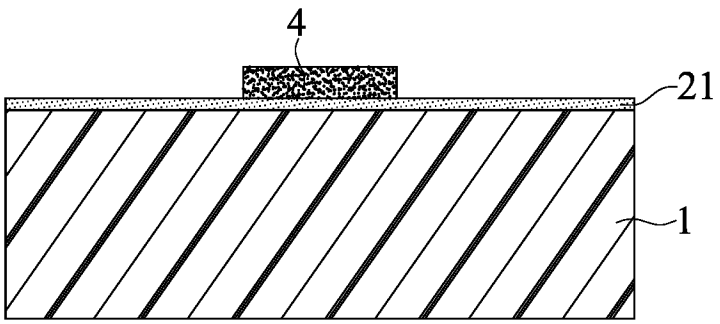

As shown in FIG. 5B, the step 2 includes: forming a sacrificial layer structure 4 having a rectangular shape on the first penetration structure 21. The sacrificial layer structure 4 can be, for example, a polycrystalline germanium (Ploy-Si).

Figure 5C:
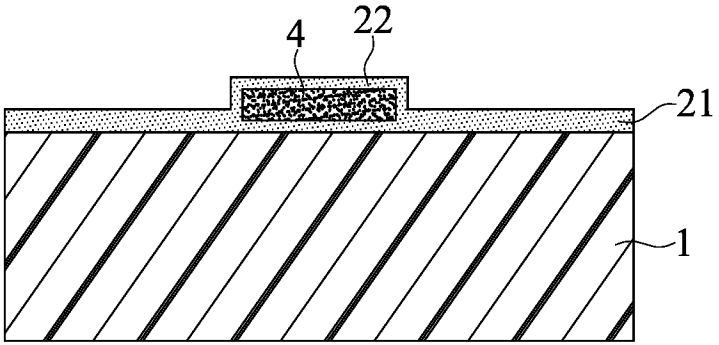

As shown in FIG. 5C, the step 3 includes: forming a second penetration structure 22 on the sacrificial layer structure 4 and the first penetration structure 21, in which the second penetration structure 22 forms a bond with the first penetration structure 21. For example, the second penetration structure 22 can be formed by depositing a layer of tantalum nitride ($Si_3N_4$) on the sacrificial layer structure 4 and the first penetration structure 21.

Figure 5D:
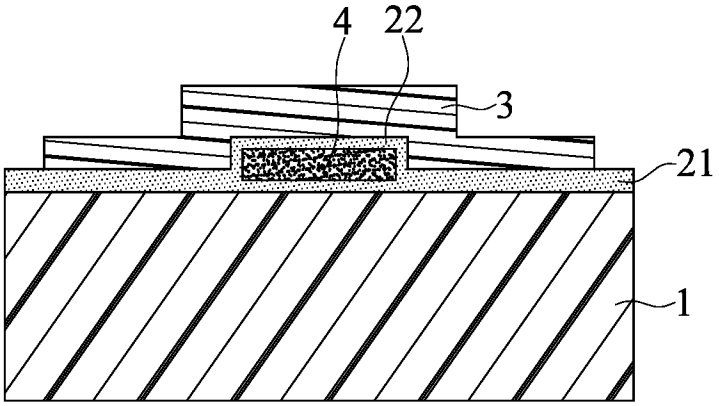

As shown in FIG. 5D, the step 4 includes: forming a fixing structure 3 on the second penetration structure 22 and the first penetration structure 21 such that the fixing structure 3 covers the periphery of the second penetration structure 22. For example, the fixing structure 3 can be formed by depositing a layer of silicon dioxide ($SiO_2$) on the second penetration structure 22 and the first penetration structure 21.

Figure 5F:
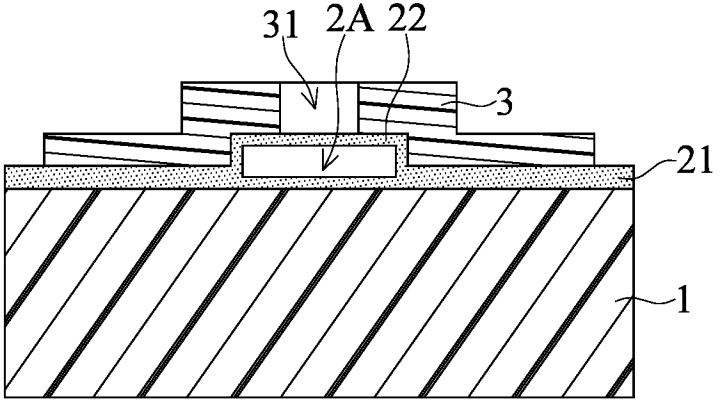
Figure 5G:
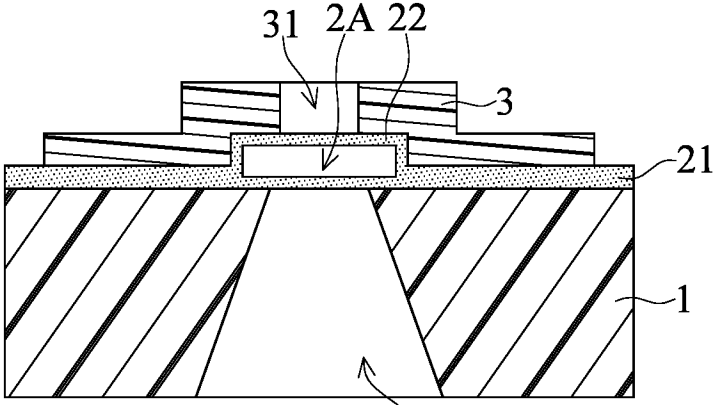
Figure 5E:
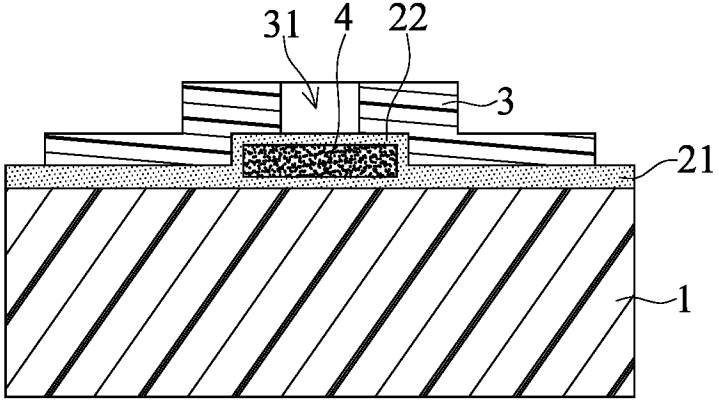

As shown in FIG. 5E, the step 5 includes: removing a portion of the fixing structure 3 located on the second penetration structure 22 to form an upper observation window 31 such that a part of the second penetration structure 22 is exposed outside the fixing structure 3 via the upper observation window 31. For example, the fixing structure 3 located on the second penetration structure 22 can be partially removed by dry etching. In addition, the maximum thickness of the fixing structure 3 can be approximately 5 micrometers, the length of the upper observation window 31 can be approximately 300 micrometers, and the width of the upper observation window 31 can be approximately 25 micrometers.

As shown in FIG. 5F, the step 6 includes: removing the sacrificial layer structure 4 located between the second penetration structure 22 and the first penetration structure 21, such that the fluid passage 2A is formed between the second penetration structure 22 and the first penetration structure 21. For example, the sacrificial layer structure 4 can be removed by dry etching or wet etching. In addition, the height of the fluid passage 2A can be between 0.1 micrometers and 0.5 micrometers, and the width of the fluid passage 2A can be approximately 120 micrometers.

As shown in FIG. 5G, the step 7 includes: removing a portion of the substrate 1 located below the first penetration structure 21 to form the lower observation window 14.

According to the above steps, the first penetration structure 21 and the second penetration structure 22 can together form a penetration structure 2 located on the first surface 10 of the substrate 1. Moreover, the space between the first penetration structure 21 and the second penetration structure 22 is correspondingly formed as part of the fluid passage 2A.

Figure 6:
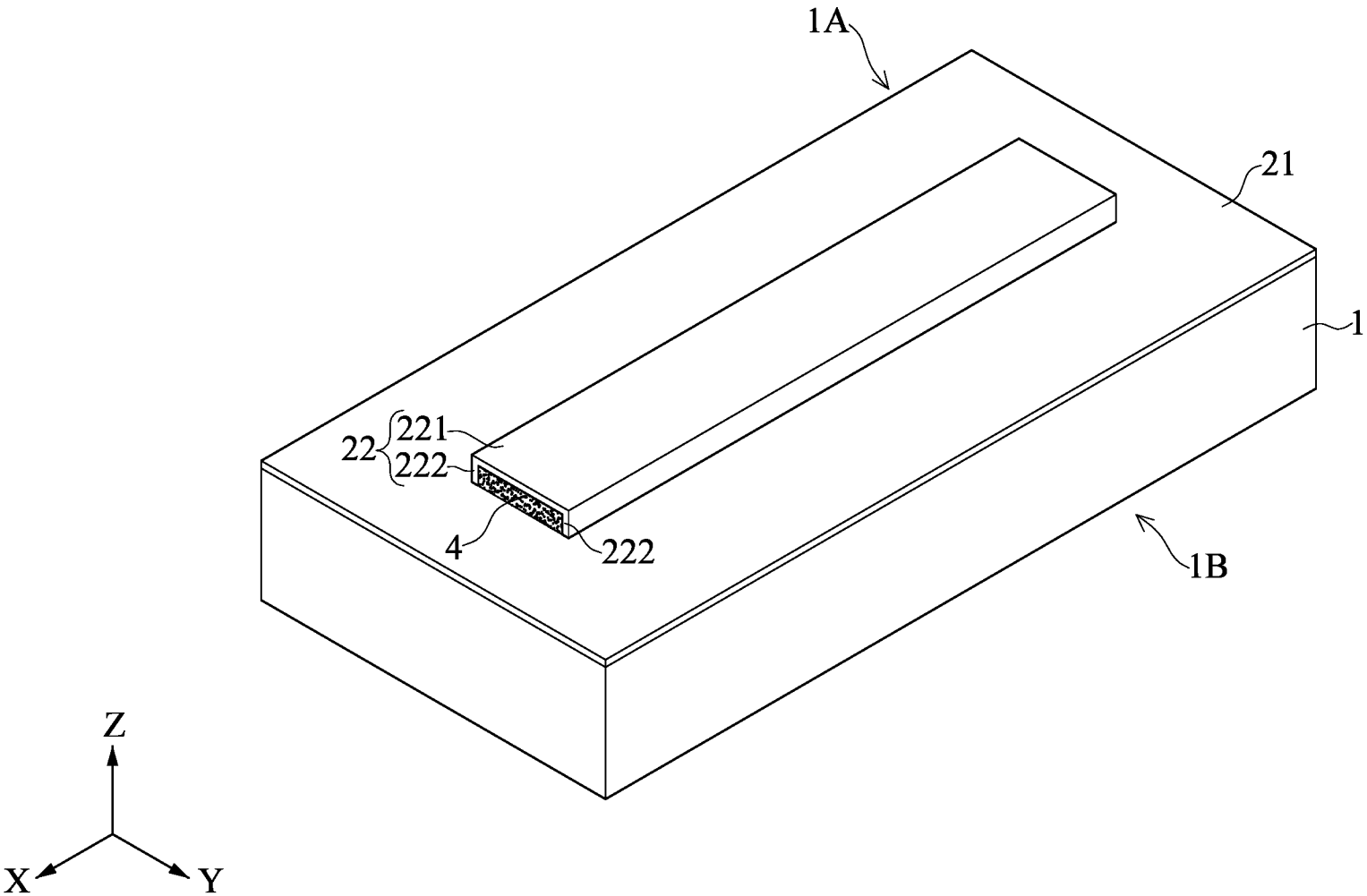
FIG. 6 is a schematic view showing the manufacturing process of the first embodiment of the sample carrier device of the present disclosure.

As shown in FIG. 6, the sample carrier device 100 of the present embodiment is manufactured by forming a penetration structure 2 having a fluid passage 2A on the surface of the single substrate 1 by a surface process technique. That is, the fluid passage 2A of the sample carrier device 100 is directly formed on one side of the single substrate 1, and the fluid passage 2A is not commonly constructed with other components. Accordingly, when the penetration structure 2 is manufactured, the relevant personnel only need to control the relevant parameters in the manufacturing process, and the required fluid passage 2A can be precisely formed.

It is worth mentioning that significant results have been produced through repeated experiments. In a comparative example, the manufacturing process of the sample carrier device includes forming two grooves respectively on two substrates; and then fixing the two substrates to each other by an adhesive, such that the two grooves and the adhesive cooperatively form a fluid passage. Since the size of the grooves is small, aligning the two grooves and applying the adhesive to a specific position in the manufacturing process are difficult, thereby resulting in a low production yield. In the present embodiment, the applicant provides a sample carrier device 100 in which a fluid passage 2A is formed only on a single substrate 1. Since the fluid passage 2A is directly formed on the single substrate 1 through the penetration structure 2, issues such as positioning, sticking, and the like will not occur, and the overall production yield can be greatly improved as compared to the comparative example.

Figure 7:
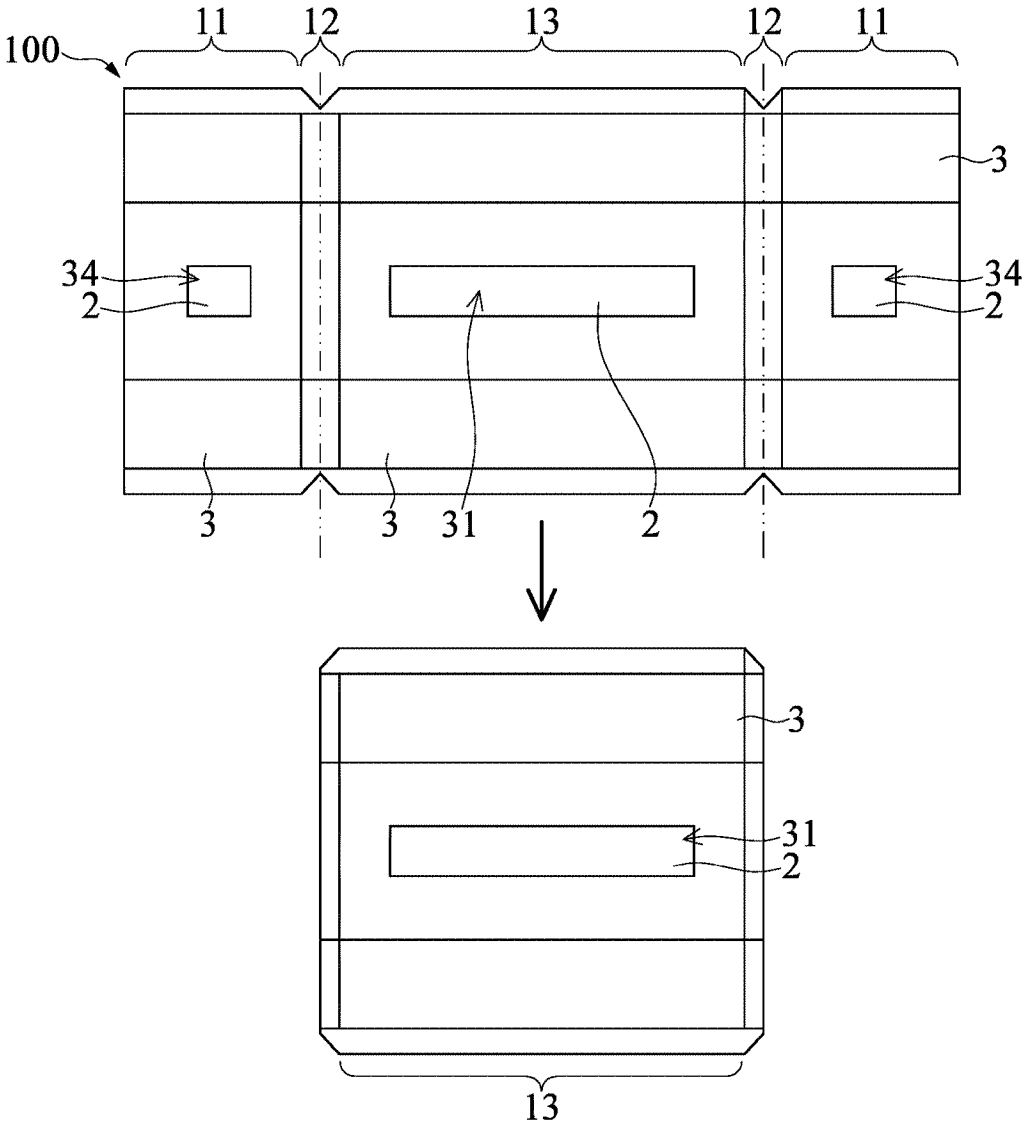
FIG. 7 is a schematic view showing an operation method of the sample carrier device according to the first embodiment of the present disclosure.
Figure 8:
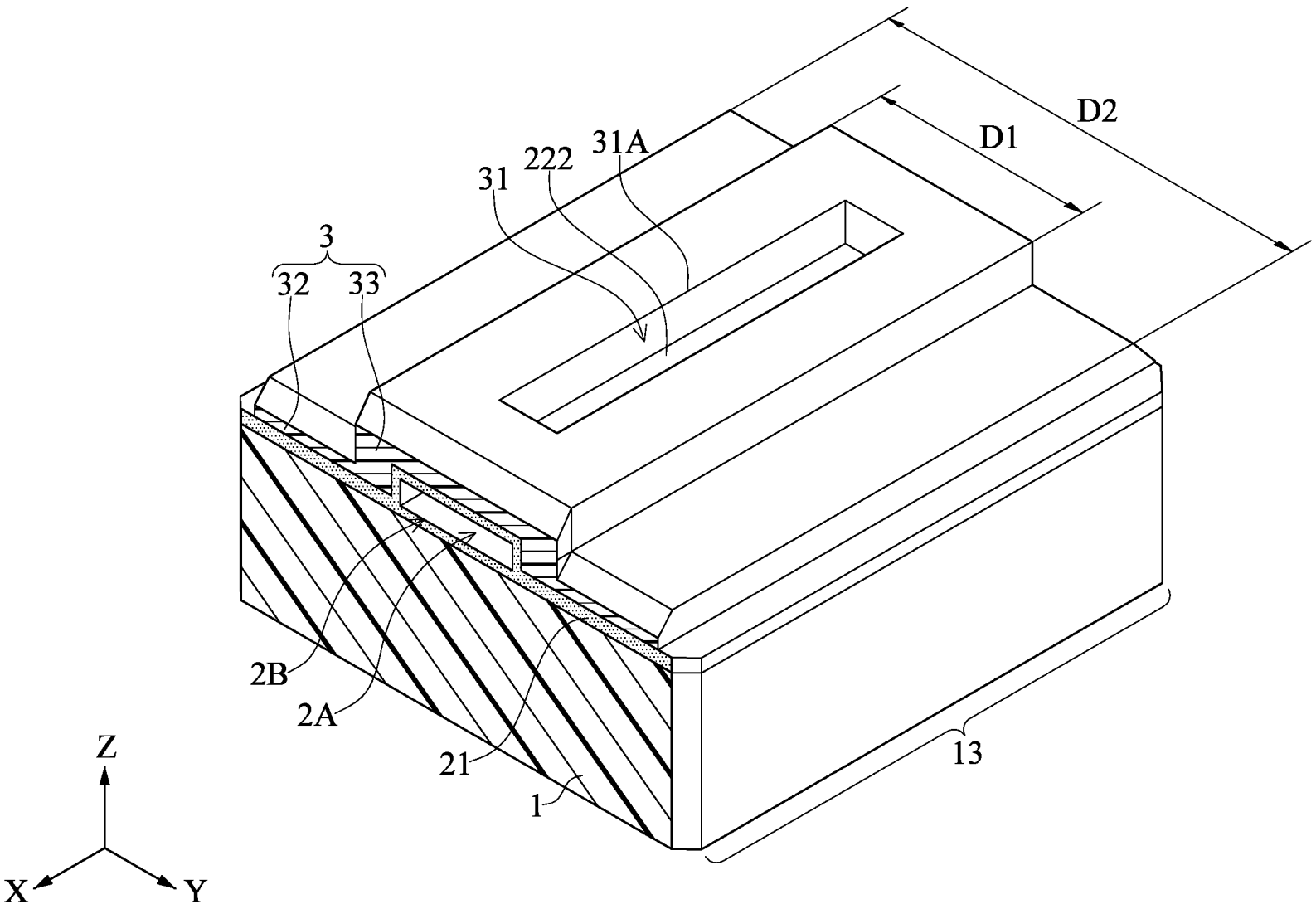
FIG. 8 is a perspective view showing a separation state of an observation portion and end portions of the sample carrier device according to the first embodiment of the present disclosure.
Figure 10:
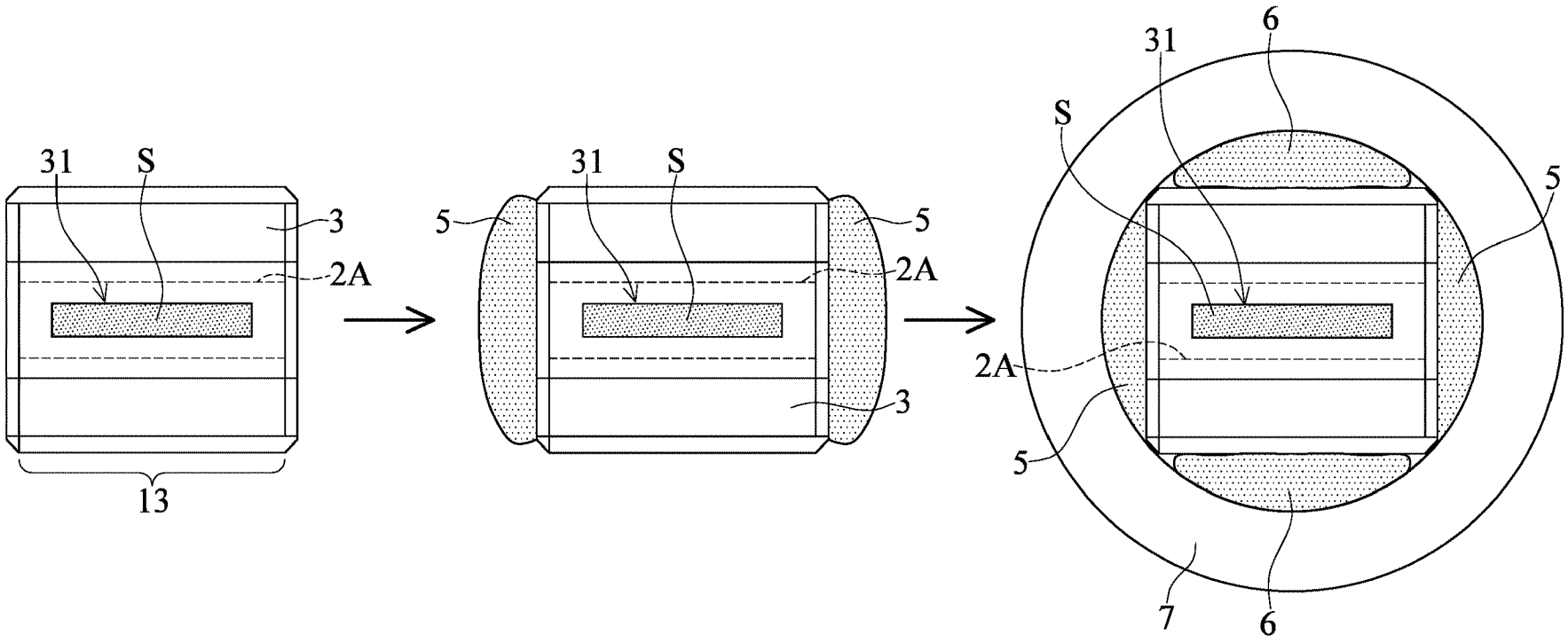
FIG. 10 is a schematic flow chart showing the mounting of a copper ring to the sample carrier device after absorbing the liquid sample.

Referring to FIG. 7 to FIG. 10, FIG. 7 is a schematic view showing an operation method of the sample carrier device according to the first embodiment of the present disclosure, FIG. 8 is a perspective view showing a separation state of the observation portion and the end portions of the sample carrier device according to the first embodiment of the present disclosure, FIG. 9 is a schematic view showing the sample carrier device when absorbing a liquid sample, and FIG. 10 is a schematic flow chart showing the mounting of a copper ring to the sample carrier device after absorbing the liquid sample.

The operation method of the sample carrier device according to the first embodiment of the present disclosure includes: a disassembling step which includes: separating the end portions 11 and the observation portion 13 such that two ports of the fluid passage 2A are respectively exposed outside the observation portion 13; a sampling step which includes: contacting a port with a sample S such that the sample S enters the fluid passage 2A through the port; and a sealing step which includes: sealing the ports to isolate the sample S within the fluid passage 2A from an external environment.

As shown FIG. 7, in the disassembling step, a user can apply an external force to the end portions 11 and the operation portions 12 by using a nipper, cutting pliers or a related tool to separate the observation portion 13 from the two end portions 11. As shown FIG. 8, when both ends of the observation portion 13 of the sample carrier device 100 do not have the end portions 11, the two ports 2B of the fluid passage 2A will be exposed outside the observation portion 13.

As shown in FIG. 9, when the ports 2B of the fluid passage 2A are exposed, the sampling step described above can be performed. That is, a user can contact one end of the fluid passage 2A with the liquid sample S, and the liquid sample S will flow into the fluid passage 2A via capillary phenomenon.

As described above, since the substrate 1 is designed to have the operation portions 12, a user can easily separate the end portions 11 from the observation portion 13 such that both ends of the fluid passage 2A can be exposed outside. Therefore, the user can use either end of the exposed fluid passage 2A to absorb the sample S.

As shown in FIG. 10, when the sample S is received in the fluid passage 2A of the observation portion 13 (as shown in the left drawing of FIG. 10), the above sealing step can be performed. That is, a user can apply a sealant 5 to the two ports 2B of the observation portion 13 to seal the fluid passage 2A (as shown in the middle drawing of FIG. 10).

After the sealing step, a user can apply an adhesive 6 to both sides of the observation portion 13 and fix a copper ring 7 (e.g., a Cu grid) to the observation portion 13 through the adhesive 6 (as shown in the drawing to the furthest right of FIG. 10). The copper ring referred to herein is, for example, a standard copper ring having a diameter of 3 mm After a user fixes the copper ring 7 to the observation portion 13 that carries the sample S, the user can place the copper ring 7 and the observation portion 13 at a predetermined observation position on a sample holder, and then the user can place the sample holder into an electron microscope device so that the sample S received in the fluid passage 2A of the observation portion 13 can be observed through the electron microscope device.

As shown in FIG. 3, when the observation portion 13 is disposed in the electron microscope device, the electron beam emitted from the electron microscope device will sequentially pass through the upper observation window 31 and the penetration structure 2, and then enter the fluid passage 2A. The electron microscope device is configured to collect the electron beam reflected by the sample S in the fluid passage 2A through the lower observation window 14, and the reflected electron beam is imaged after analysis for observation by the user. It is worth mentioning that the penetration structure 2 of the present disclosure is represented as a structure that can allow an electron beam to pass through. In other words, the thickness of the penetration structure 2 and its material can be changed according to actual need, and the present disclosure is not limited thereto.

The size of the observation portion 13 of the sample carrier device 100 of the present embodiment only needs to be appropriately designed, so that the observation portion 13 can be fixed on a standard copper ring used in various electron microscope devices. That is, the sample carrier device 100 of the present embodiment can be applied to various sample holders of electron microscope devices from various brands. Since the fluid passage 2A of the sample carrier device 100 of the present embodiment can carry fluid, a user can utilize the sample carrier device 100 to carry any liquid sample that can enter the fluid passage 2A. Accordingly, the user can observe the liquid sample using the electron microscope device.

As shown in FIG. 8, in practice, the fixing structure 3 has a base portion 32 and a protrusion portion 33. The base portion 32 is formed on the first penetration structure 21, and the protrusion portion 33 extends from the base portion 32 towards a direction away from the substrate (i.e. the Z-axis direction of the coordinates shown in FIG. 8). The width D1 of the protrusion portion 33 in the width direction of the sample carrier device 100 is smaller than the width D2 of the base portion 32 in the width direction of the sample carrier device 100. In addition, the protrusion portion 33 and the base portion 32 together form a stepped structure. The upper observation window 31 forms an opening 31A on the surface of the protrusion portion 33 opposite to the substrate 1.

As shown in FIG. 8 and FIG. 10, owing to the structural design of the base portion 32 and the protrusion portion 33, when a user applies the adhesive 6 to both sides of the observation portion 13, the adhesive 6 will easily stay at the intersection between the base portion 32 and the protrusion portion 33, and the adhesive 6 will not easily climb over the protrusion portion 33 to enter the upper observation window 31, whereby the probability of the adhesive 6 entering the upper observation window 31 can be greatly reduced.

Referring to FIG. 1 and FIG. 3 again, in practice, the fixing structure 3 further has two through holes 34. Each of the through holes 34 is formed through the fixing structure 3, and the through holes 34 are located above the fluid passage 2A and located at the end portions 11, respectively. Each of the through holes 34 is configured to expose a part of the first penetration structure 21 outside the fixing structure 3.

As described above, when the sample carrier device 100 is completed, the fluid passage 2A is a closed passage formed by the first penetration structure 21 and the second penetration structure 22. Owing to the design of the through holes 34, when a user wishes to inject the sample S into the fluid passage 2A, the user can not only use a nipper or cutting pliers to separate the end portions 11 from the observation portion 13, but also can use a suitable operation tool (i.e. piercing tool) to pierce the penetration structure 2 through the through hole 34, thereby enabling the fluid passage 2A to spatially communicate with an external environment. Accordingly, the user can inject the sample S into the fluid passage 2A via the through hole 34.

In an alternative embodiment, the operation method of the sample carrier device includes: a sampling step which includes: using an operation tool to pierce the penetration structure 2 exposed through the through hole 34, such that the fluid passage 2A spatially communicates with an external environment, and a user can inject the sample S into the fluid passage 2A through the through hole 34; a disassembling step which includes: separating the end portions 11 from the observation portion 13 to expose the two ports of the fluid passage 2A located at the observation portion 13; and a sealing step which includes: sealing the two ports to isolate the sample S within the fluid passage 2A from the external environment.

It is worth mentioning that in practice, the front end of the operation tool can be provided with an adhesive, and the operation tool can adhere the broken penetration structure 2 by the adhesive after the front end of the operation tool pierces the penetration structure 2.

In a variant embodiment, a side of the single substrate 1 of the sample carrier device 100 can be formed with two or more fluid passages 2A independent from each other. That is, the first surface 10 of the first side 1A of the substrate 1 is formed with the first penetration structure 21, the two second penetration structures 22 are respectively formed on the first penetration structure 21, and the two second penetration structures 22 respectively form the two fluid passages 2A with the first penetration structure 21. Owing to the design of the two fluid passages 2A, a user can use the same sample carrier device 100 to carry two different samples S.

In the embodiment in which the sample carrier device 100 has two fluid passages 2A, the fixing structure 3 of the sample carrier device 100 can have two through holes 34 corresponding to each of the fluid passages 2A. That is, the fixing structure 3 has four through holes 34, two of which can expose the second penetration structure 22 that forms one of the fluid passages 2A, and the other two of which can expose the second penetration structure 22 that forms the other one of the fluid passages 2A. For the sake of explanation, the present disclosure assumes that two of the through holes 34 corresponding to one of the fluid passages 2A are defined as first through holes, and the fluid passage 2A corresponding to the two first through holes 34 is defined as a first fluid passage. The other two of the through holes 34 corresponding to the other fluid passage 2A are defined as second through holes, and the fluid passage 2A corresponding to the two second through holes is defined as the second fluid passage. In addition, the two different samples S are defined as a first sample and a second sample, respectively.

The process of injecting the first sample and the second sample into the sample carrier device 100 by a user includes: firstly piercing the corresponding second penetration structure 22 through one of the first through holes by using the relevant operating tool, such that the first fluid passage spatially communicates with the external environment; and then injecting the first sample into the first fluid passage through the first through hole. Next, a user can use another operation tool to pierce the corresponding second penetration structure through one of the second through holes, such that the second fluid passage spatially communicates with the external environment. Accordingly, a user can inject the second sample into the second fluid passage through the second through hole. After the user injects the first sample and the second sample into the first fluid passage and the second fluid passage, respectively, the user can separate the two end portions 11 from the observation portion 13. Finally, the user can fix the observation portion 13 together with the copper ring on the sample holder according to the flow chart shown in FIG. 10.

Second Embodiment

Figure 11:
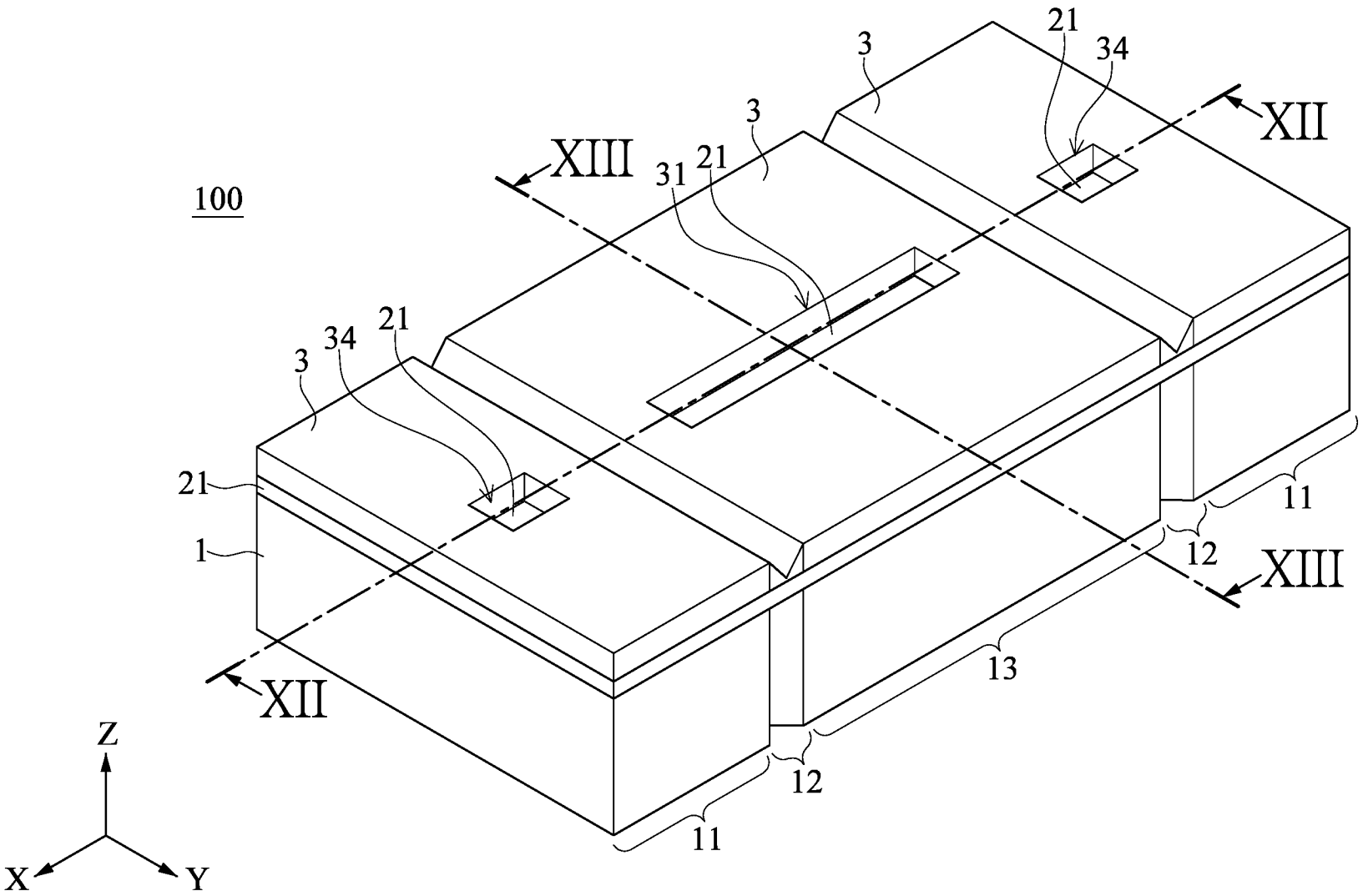
FIG. 11 is a perspective view showing a sample carrier device according to a second embodiment of the present disclosure.
Figure 12:
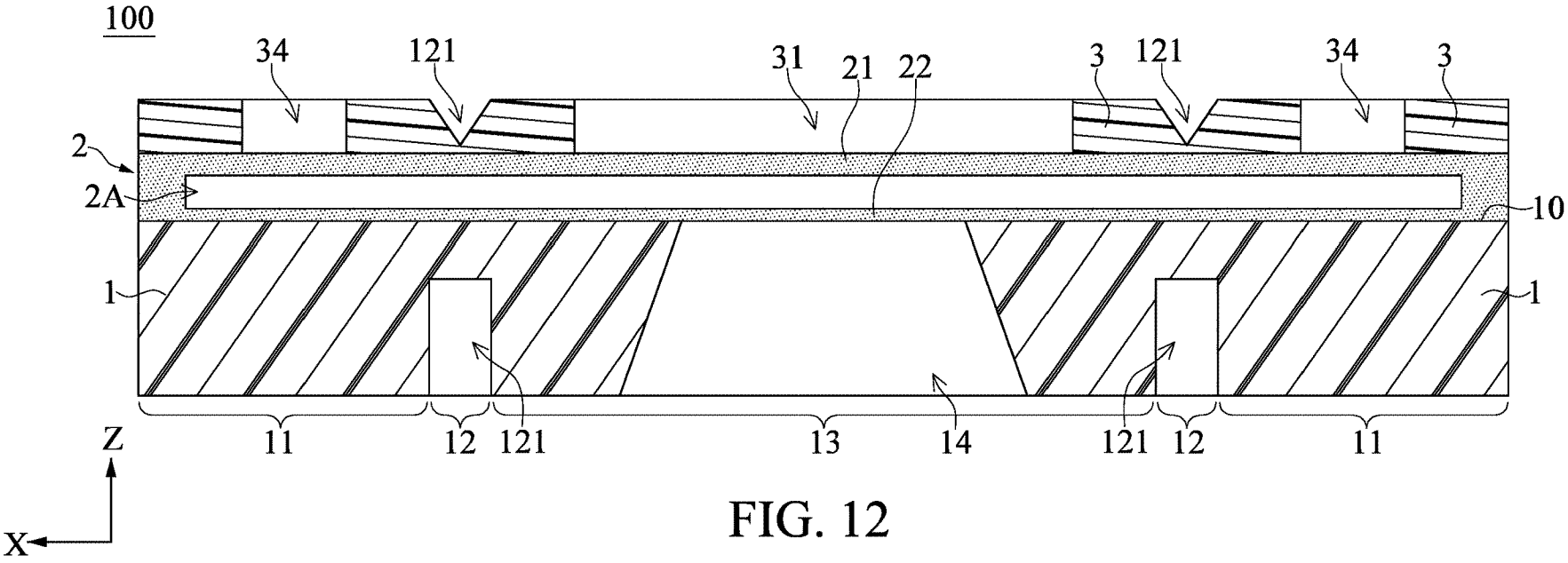
FIG. 12 is a cross-sectional view taken along line XII-XII of FIG. 11.
Figure 13:
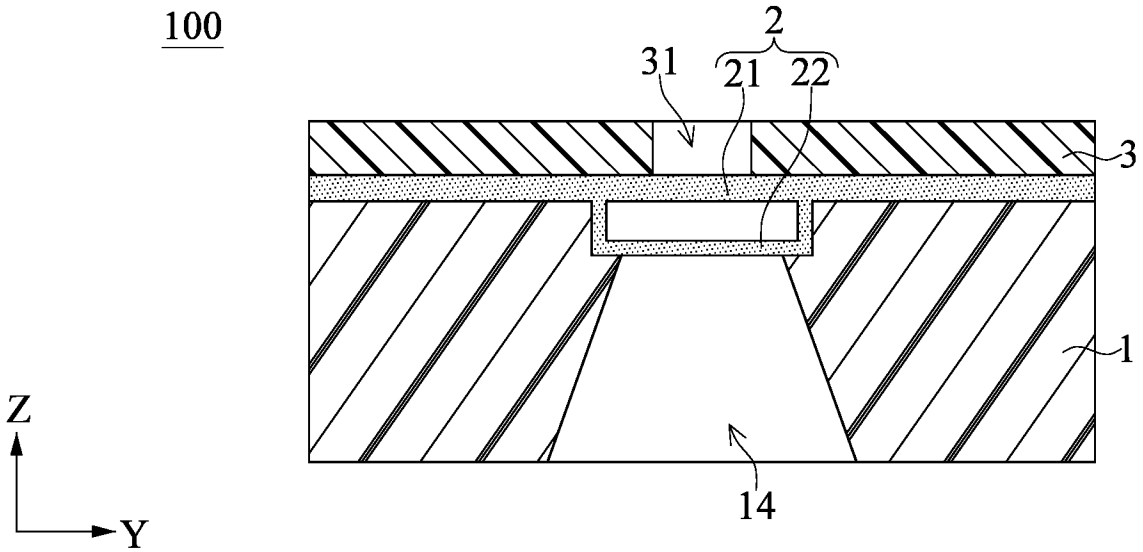
FIG. 13 is a cross-sectional view taken along line XIII-XIII of FIG. 11.

Referring to FIG. 11 to FIG. 14, FIG. 11 is a perspective view of a sample carrier device according to a second embodiment of the present disclosure, FIG. 12 is a cross-sectional view taken along line XII-XII of FIG. 11, FIG. 13 is a cross-sectional view taken along line XIII-XIII of FIG. 11, and FIG. 14A to FIG. 14G are schematic diagrams showing the manufacturing process of the sample carrier device according to the second embodiment of the present disclosure. The difference between the present embodiment and the foregoing embodiment is that: the fluid passage 2A of the sample carrier device 100 of the first embodiment is formed on the first surface 10 of the first side 1A of the substrate 1, and the fluid passage 2A of the sample carrier device 100 of the present embodiment is embedded in the substrate 1.

As shown in FIG. 14A to FIG. 14G, the manufacturing process of the sample carrier device 100 according to the present embodiment includes the following steps (steps 1 to 7).

Figure 14A:
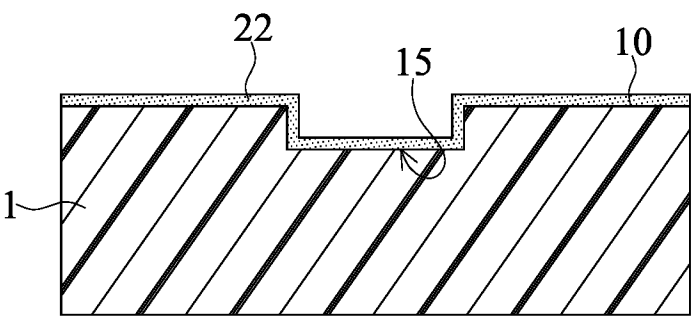
FIG. 14A to FIG. 14G are schematic diagrams showing a manufacturing process of the sample carrier device according to the second embodiment of the present disclosure.

As shown in FIG. 14A, the step 1 includes: forming a groove 15 recessed in the first surface 10 of the first side 1A of the substrate 1; and then forming a second penetration structure 22 on the first surface 10 of the substrate 1 and the wall surface that forms the groove 15. For example, the second penetration structure 22 can be formed by depositing a layer of tantalum nitride ($Si_3N_4$) on the first surface 10 and the wall surface that forms the groove 15.

Figure 14B:
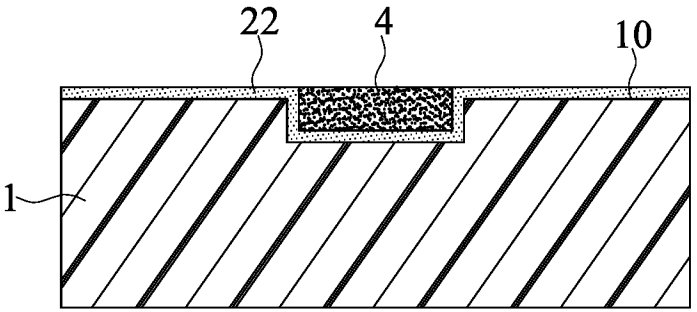

As shown in FIG. 14B, the step 2 includes: forming a sacrificial layer structure 4 on the part of the second penetration structure 22 located in the groove 15. The sacrificial layer structure 4 can be, for example, a polycrystalline germanium (Ploy-Si).

Figure 14C:
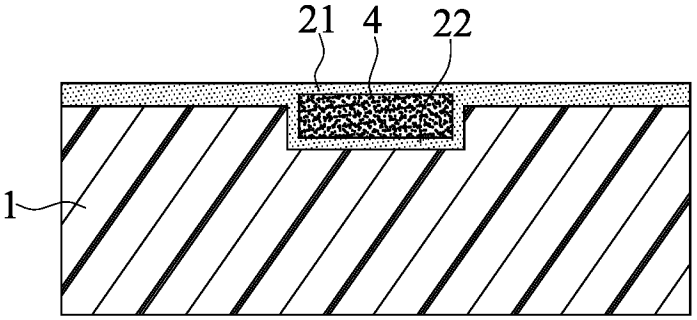

As shown in FIG. 14C, the step 3 includes: forming a first penetration structure 21 on the sacrificial layer structure 4 and the second penetration structure 22, in which the first penetration structure 21 forms a bond with the second penetration structure 22. For example, the first penetration structure 21 can be formed by depositing a layer of tantalum nitride ($Si_3N_4$) on the sacrificial layer structure 4 and the second penetration structure 22.

Figure 14D:
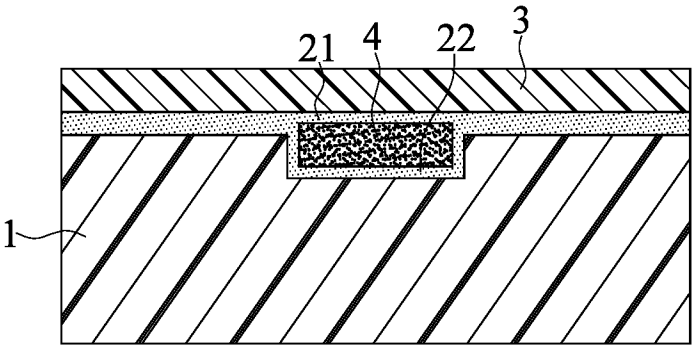

As shown in FIG. 14D, the step 4 includes: forming a fixing structure 3 on a side of the first penetration structure 21 opposite to the substrate 1. For example, the fixing structure 3 can be formed by depositing a layer of silicon dioxide ($SiO_2$) on the first penetration structure 21.

Figure 14F:
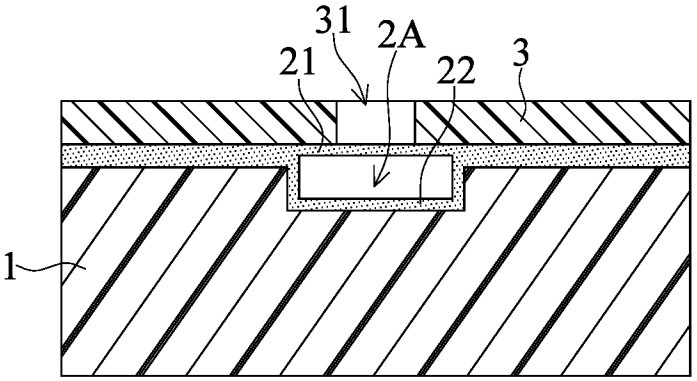
Figure 14G:
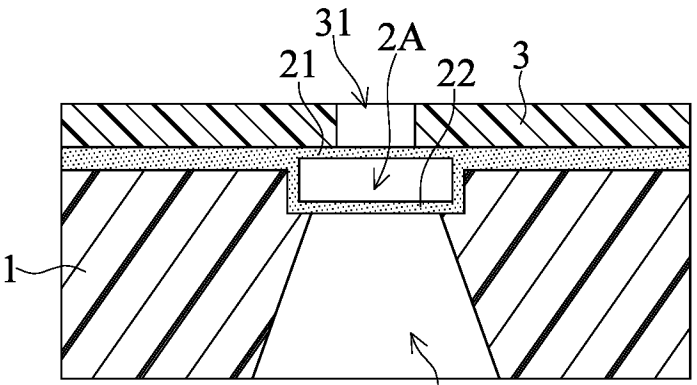
Figure 14E:
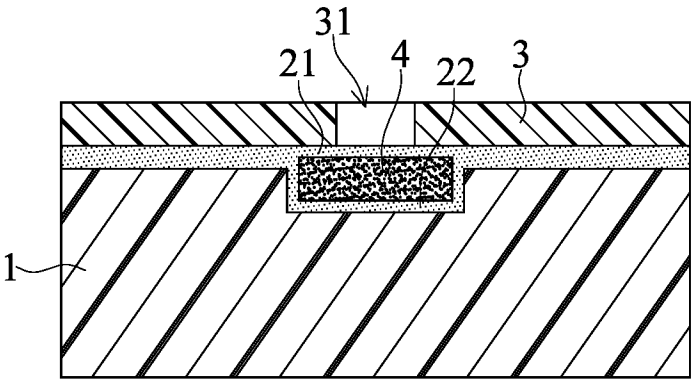

As shown in FIG. 14E, the step 5 includes: removing a portion of the fixing structure 3 to form an upper observation window 31 such that a part of the first penetration structure 21 is exposed outside the fixing structure 3 via the upper observation window 31. For example, the fixing structure 3 located on the first penetration structure 21 can be partially removed by dry etching.

As shown in FIG. 14F, the step 6 includes: removing the sacrificial layer structure 4 located between the second penetration structure 22 and the first penetration structure 21, such that the fluid passage 2A is formed between the second penetration structure 22 and the first penetration structure 21. For example, the sacrificial layer structure 4 can be removed by dry etching or wet etching.

As shown in FIG. 14G the step 7 includes: removing a portion of the substrate 1 located below the second penetration structure 22 to form the lower observation window 14.

Further referring to FIG. 11 and FIG. 12, similar to the first embodiment, the fixing structure 3 of the present embodiment also has two through holes 34. The two through holes 34 are correspondingly located above the fluid passage 2A. Each of the through holes 34 is formed through the fixing structure 3. Each of the through holes 34 is configured to expose a part of the first penetration structure 21 outside the fixing structure 3. Similar to the first embodiment, when using the sample carrier device 100 of the present embodiment, a user can use a relevant operation tool (i.e. piercing tool) to pierce the first penetration structure 21 through the through hole 34, thereby enabling the fluid passage 2A to spatially communicate with an external environment.

Similar to the first embodiment, the sample carrier device 100 of the present embodiment can be divided into two end portions 11, two operation portions 12, and an observation portion 13. The two end portions 11 are located at two ends of the sample carrier device 100, respectively. One of the operation portions 12 is located between one of the end portions 11 and the observation portion 13, and the other one of the operation portions 12 is located between the other one of the end portions 11 and the observation portion 13. When using the sample carrier device 100 of the present embodiment, a user can apply an external force to the operation portions 12, such that the end portions 11 can be separated from the observation portion 13, and two ports of the fluid passage 2A can be exposed outside the observation portion 13. When the ports of the fluid passage 2A are exposed outside, the user can directly contact any one of the ports of the fluid passage 2A with a liquid sample S to enable the liquid sample S to flow into the fluid passage 2A via capillary action. Further, the user can refer the operation steps shown in FIG. 10 to fix the sample carrier device 100 that carries the liquid sample S to the standard copper ring 7 to complete the preliminary work of placing the sample holder on the electron microscope device.

It is worth mentioning that in various applications, the side of the fixing structure 3 opposite to the substrate 1 can be formed with a protrusion portion 33 as shown in FIG. 4. The design of the protrusion portion 33 can reduce the probability that the adhesive 6 used to secure the observation portion 13 and the copper ring 7 (shown in FIG. 10) enters the upper observation window 31.

Third Embodiment

Figure 15:
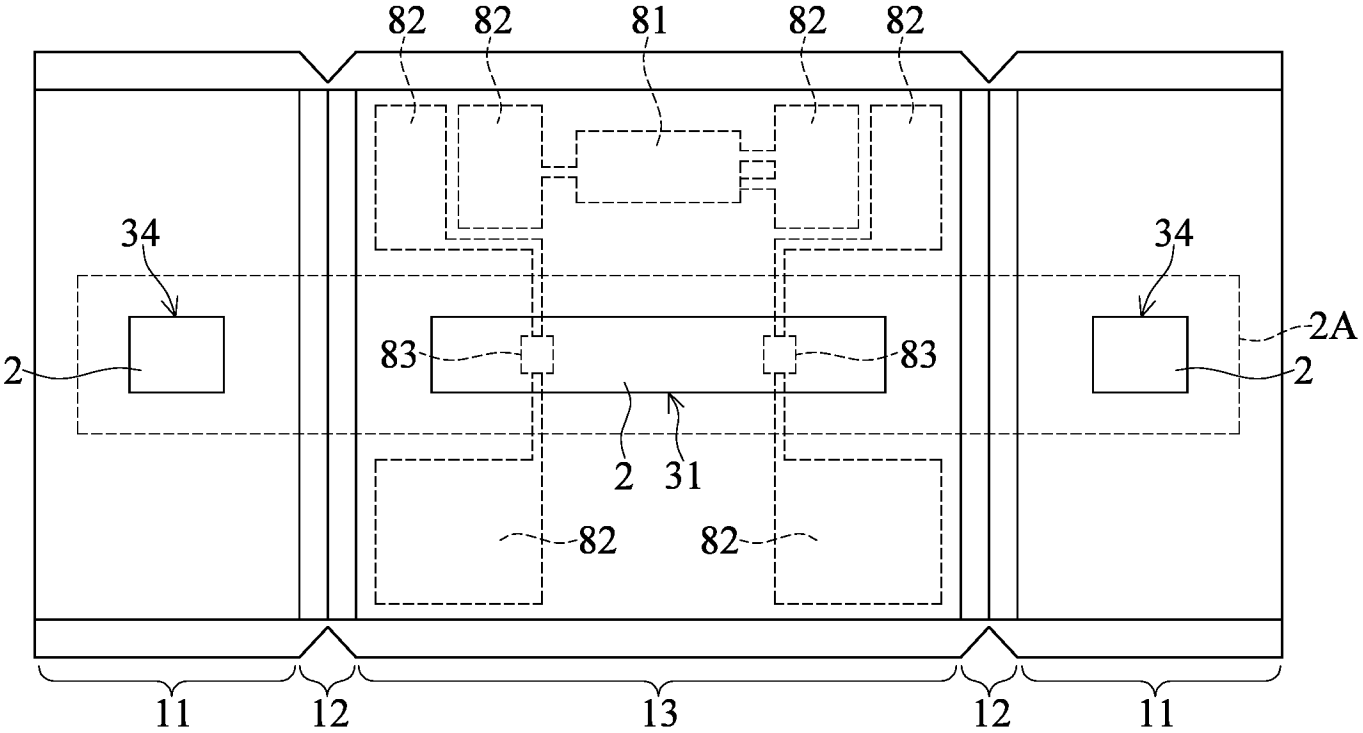
FIG. 15 is a top view of a sample carrier device according to a third embodiment of the present disclosure.

Referring to FIG. 15, which is a top view of a sample carrier device according to a third embodiment of the present disclosure, the difference between the present embodiment and the foregoing embodiment is that: the penetration structure 2 is further provided with a control module. The control module includes a control circuit 81, a plurality of metal contacts 82, and a plurality of electrode structures 83. The control circuit 81 is electrically connected to the metal contacts 82. Each of the metal contacts 82 is exposed outside the fixing structure 3, for example, the fixing structure 3 can have corresponding through holes to expose the metal contacts 82, respectively. The electrode structures 83 are correspondingly located in the fluid passage 2A. For example, the substrate 1 can be a silicon substrate, the penetration structure 2 can be formed on the substrate 1 by using a semiconductor process, and the control module can be formed on the penetration structure 2 by using the semiconductor process. In practice, the material of the electrode structure 83 can be at least one selected from the group consisting of platinum (Pt), copper (Cu), titanium (Ti), chromium (Cr), and tungsten (W). Alternatively, the material of the electrode structure 83 can also be, for example, a semiconductor material such as polycrystalline germanium, aluminum nitride (AlN), aluminum oxide ($AlO_2$), zinc oxide (ZnO), or titanium dioxide ($TiO_2$).

As shown in FIG. 5A, in the manufacturing process of the sample carrier device 100, after the first penetration structure 21 is formed on the first surface 10 of the substrate 1 and before the sacrificial layer structure 4 is formed on the first penetration structure 21, the control module can be formed on the side of the first penetration structure 21 opposite to the substrate 1 between the above two processes. When the sacrificial layer structure 4 is formed, the sacrificial layer structure 4 is formed on the electrode structures 83. After sequentially forming the second penetration structure 22 and removing the sacrificial layer structure 4, the electrode structures 83 are correspondingly located in the fluid passage 2A. The electrode structures 83 can be electrically connected to the control circuit 81 located outside the fluid passage 2A through the metal contacts 82. In addition, when the upper observation window 31 is formed, the fixing structure 3 can simultaneously form a plurality of through holes for exposing the metal contacts 82. It should be noted that the control module is not limited to being formed on the first penetration structure 21 as shown in FIG. 5A, some or all of the components of the control module can also be formed on the second penetration structure 22 as shown in FIG. 5C. In practice, in the process of forming the control module on the second penetration structure 22, a portion of the second penetration structure 22 can be removed according to actual needs, such that the second penetration structure 22 forms a plurality of through holes. Further, the through holes can provide a plurality of conductive structures to be filled therein to form the metal contacts 82.

As described above, in practice, a user can use a relevant operation tool to pierce a portion of the penetration structure 2 through the through holes 34 of the fixing structure 3, so that the sample S can enter the fluid passage 2A through any one of the through holes 34. After the sample S is disposed in the fluid passage 2A, the user can connect a processing device to the metal contacts 82 by using a plurality of wires to supply power and signals to the control circuit 81 through the metal contacts 82. The control circuit 81 can cooperate with the electrode structures 83 to perform correlation processing on the sample S in the fluid passage 2A according to the signal. For example, the number of the electrode structures 83 of the present embodiment can be two, and the two electrode structures 83 can be an anode and a cathode, respectively. Accordingly, after the two electrode structures 83 are energized, the liquid sample S located in the fluid passage 2A is subjected to electrophoresis so that some of the substances in the liquid sample S can be separated from each other.

In various applications, the control circuit 81 and the electrode structures 83 can also collectively form a sensing circuit. The associated processing device can supply power to the control circuit through the wires and metal contacts 82, and the processing device can receive the associated sensed signals that are returned by the control circuit 81. The sensing circuit can be, for example, used to sense the temperature or other physical properties of the sample S located in the fluid passage 2A.

Fourth Embodiment

Figure 16:
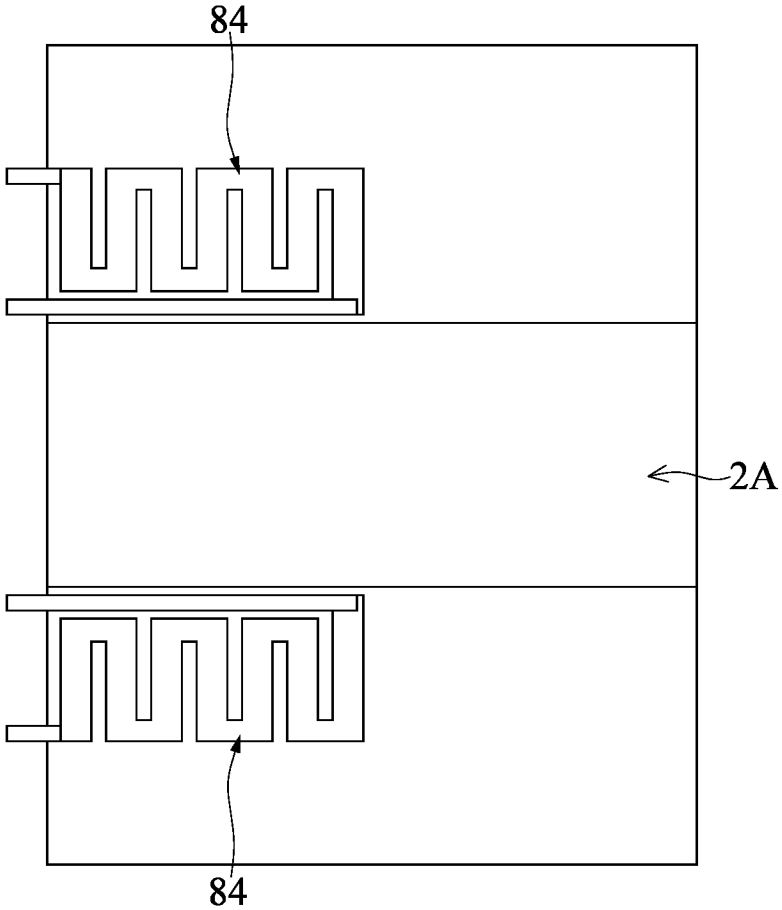
FIG. 16 is a partially enlarged view of a sample carrier device according to a fourth embodiment of the present disclosure.

Referring to FIG. 16, a partially enlarged view of a sample carrier device 100 according to a fourth embodiment of the present disclosure is illustrated. In various applications, the control module further includes a plurality of heating members 84 disposed around the fluid passage 2A. That is, the heating members 84 can be formed adjacent to the position where the first penetration structure 21 is adjacent to the fluid passage 2A. Each of the heating members 84 can be, for example, a resistance wire composed of a metal material such as chromium (Cr) or titanium (Ti). The heating members 84 are correspondingly connected to the metal contacts 82, and the metal contacts 82 are exposed outside the fixing structure 3. Accordingly, a user can supply power to the heating members 84 through the metal contacts 82, so that the heating members 84 can generate thermal energy to change the temperature of the sample S located in the fluid passage 2A.

As described above, after the sample carrier device 100 carries a sample S and before the sample carrier device 100 is placed on a sample holder, a user can perform a pre-treating operation on the sample S located in the fluid passage 2A by using the control module or the heating members 84. After performing the pre-treating operation on the sample S, the user can place the sample carrier device 100 on the sample holder, and feed the sample holder into the electron microscope device, so that the user can observe the sample S that is pre-treated under the electron microscope device.

In a special configuration, the control module and the heating members 84 can be formed on the observation portion 13. The user can fix the observation portion 13 on the sample holder, and then the user can electrically connect the metal contacts 82 to the associated power supply on the sample holder through the wires. Accordingly, the user can perform electrophoresis separation and heat treatment and the like on the sample S in the sample carrier device 100 by operating the sample holder after the sample holder is fed into the electron microscope apparatus. That is, the user can perform relevant processing on the sample S in the sample carrier device 100 by operating the sample holder under the electron microscope device.

Fifth Embodiment

Figure 17:
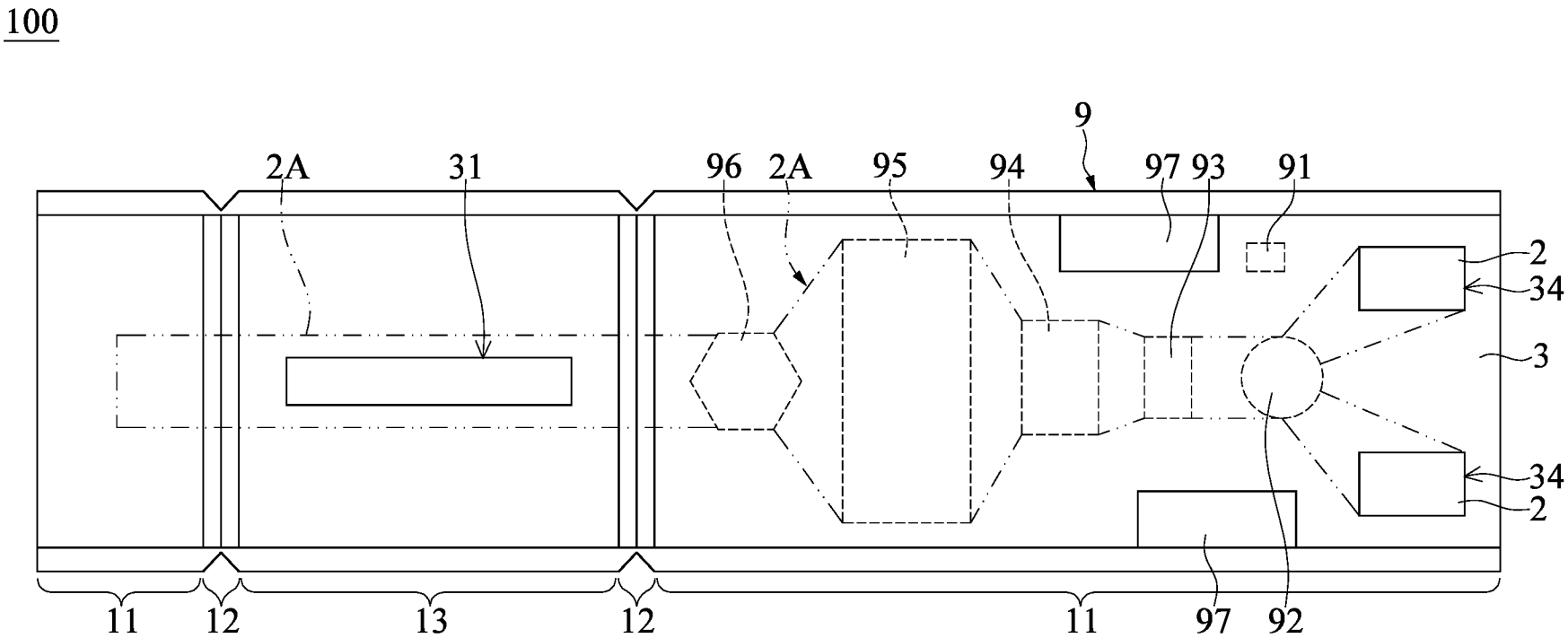
FIG. 17 is a top view of a sample carrier device according to a fifth embodiment of the present disclosure.

Referring to FIG. 17, which is a top view of a sample carrier device according to a fifth embodiment of the present disclosure, the difference between the present embodiment and the foregoing embodiment is that: the sample carrier device 100 of the present embodiment has two end portions 11, two operation portions 12, and an observation portion 13, and one of the end portions 11 can be formed with a microfluidic chip 9. The microfluidic chip 9 can be formed on the first surface 10 of the substrate 1 by means of a semiconductor process, a microelectromechanical process (MEMS) or the like. The fixing structure 3 is formed on a side of the microfluidic chip 9 opposite to the substrate 1. The fixing structure 3 formed on the microfluidic chip 9 includes two through holes 34, each of the through holes 34 is formed through the fixing structure 3, and each of the through holes 34 is configured to expose a part of the penetration structure 2. Moreover, a portion of the fluid passage 2A of the sample carrier device 100 (as indicated by the dashed line on the right in FIG. 17) is correspondingly located at the microfluidic chip 9.

Similar to the foregoing embodiment, when using the microfluidic chip 9, a user may use an associated operation tool to pierce the penetration structure 2 through the corresponding through hole 34 to spatially communicate the fluid passage 2A located at the microfluidic chip 9 with an external environment. Accordingly, the user can inject the sample S into the fluid passage 2A located at the microfluidic chip 9 through the corresponding through hole 34.

The microfluidic chip 9 includes a main controller 91, a mixer 92, a flow controller 93, a heater 94, a filter 95, a switch 96, and two metal contacts 97. The mixer 92, the flow controller 93, the heater 94, the filter 95 and the switch 96 are correspondingly connected to the main controller 91. The main controller 91 is connected to the two metal contacts 97. The two metal contacts 97 are exposed outside the microfluidic chip 9, and the two metal contacts 97 are configured to be connected to an external processing device for obtaining power and control signals from the external processing device. After the controller 91 obtains power and control signals through the two metal contacts 97, the controller 91 activates the corresponding mixer 92, the flow controller 93, the heater 94, and the filter 95 to perform the processing operations of heating, stirring, filtering, and the like on the sample S that has entered the fluid passage 2A through the through hole 34.

The switch 96 can be controlled by the main controller 91 to enable the fluid passage 2A located at the microfluidic chip 9 and the fluid passage 2A located at the observation portion 13 to spatially communicate or not spatially communicate with each other. In practical applications, the user may transmit the signal to the main controller 91 through the two metal contacts 97 so that the fluid passage 2A located at the microfluidic chip 9 and the fluid passage 2A located at the observation portion 13 do not spatially communicate with each other. After the sample S is injected into the fluid passage 2A located at the microfluidic chip 9 through the through hole 34 located at the microfluidic chip, and after the mixer 92, the flow controller 93, the heater 94, and the filter 95 perform relevant processing on sample S, the switch 96 can be controlled to enable the fluid passage 2A located at the microfluidic chip 9 and the fluid passage 2A located at the observation portion 13 to spatially communicate with each other.

When the switch 96 is controlled to operate and after the sample S located in the fluid passage 2A of the microfluidic chip 9 flows into the fluid passage 2A located at the observation portion 13, the controller 91 can then control the switch 96 to be closed. At this time, the user can apply an external force on the microfluidic chip 9 to separate the microfluidic chip 9 from the observation portion 13, and then the user can place the sample S processed by the microfluidic chip 9 on the sample holder. Accordingly, the user can observe the sample S under the electron microscope device.

As described above, the components included in the microfluidic chip 9 shown in FIG. 17 are merely one of the exemplary embodiments. In practical applications, the components included in the microfluidic chip 9 are not limited to the main controller 91, the mixer 92, the flow controller 93, the heater 94, the filter 95 and the switch 96, and can vary according to actual needs. That is, any microfluidic chip 9 that can be used to treat a biological sample (i.e. blood, bacteria, viruses, etc.) or a non-biological sample (i e nanodrug, nanomaterial, chemical solvent, polishing solution, etc.) is in accordance with the spirit of the present disclosure and is within the scope of the present disclosure.

As described above, the sample carrier device 100 of the present embodiment is designed to form the microfluidic chip 9 through one of the end portions 11, so that the user can inject the sample S into the microfluidic chip 9 for relevant pre-processing, and then enable the sample S to enter into the fluid passage 2A of the observation portion 13. Finally, the user can directly separate the microfluidic chip 9 from the observation portion 13 by operating the corresponding operation portion 12. The observation portion 13 separated from the microfluidic chip 9 can be fixed on a copper ring, and can be placed on a sample holder. Further, the sample holder can be placed into an electron microscope device for observation.

In summary, the sample carrier device of the present disclosure forms a penetration structure having a fluid passage located at one side of a single substrate, and a user can inject a sample into the fluid passage by simply operating the sample carrier device. When the sample carrier device carries the sample, the user can fix the sample carrier device on a standard copper ring, and then place the sample carrier device and the standard copper ring together at a predetermined observation position on the sample holder. Finally, after the sample holder is placed into an electron microscope device, the user can observe the sample, especially a liquid sample, disposed in the fluid passage of the sample carrier device through the electron microscope device. Therefore, by forming a penetration structure and a fluid passage on a single substrate, the production cost of the sample carrier device can be greatly reduced, and the production yield of the sample carrier device can be greatly improved. Moreover, the sample carrier device of the present disclosure allows the user to observe the liquid sample under the electron microscope device through the structural design of the fluid passage.

In various embodiments of the present disclosure, the substrate of the sample carrier device can also be formed with related control circuits, heaters and the like. After the sample is injected into the fluid passage of the sample carrier device, the user can pre-treat the sample located in the fluid passage by using the control circuit, the heater, and the like, and then the user can fix the observation portion on the sample holder together with the copper ring by a simple operation, or the user can directly place the observation portion on an observation stage inside the electron microscope device. Therefore, in the embodiment in which the sample carrier device has a control circuit, a heater, and the like, the user can directly inject the sample into the sample carrier device and directly energize the sample carrier device, so that the carried samples can be subjected to relevant processing operations. After completing the processing operations, the user can directly place the observation portion of the sample carrier device on the sample holder, or directly place the observation portion on the observation stage inside the electron microscope device. In other words, the user only needs to inject the sample into the sample carrier device, and the sample carrier device can be used to perform related processing on the sample, and then the observation portion of the sample carrier device can be directly disposed on the sample holder, or the observation portion can be directly placed on the observation stage inside the electron microscope for observation. Accordingly, the sample preparation time can be greatly reduced, and the sample preparation process can be greatly simplified.

In various embodiments of the present disclosure, one end portion of the sample carrier device can also be formed with a microfluidic chip, and the fluid passage of the sample carrier device is connected to the microfluidic chip. The user can inject the sample into the fluid passage of the microfluidic chip and use the microfluidic chip to pre-treat the sample, and then enable the sample from the fluid passage of the microfluidic chip to flow into the fluid passage of the observation portion. Finally, the observation portion that carried the sample can be placed on the sample holder. In other words, the user can inject the sample into the microfluidic chip for correlation processing, and then enable the sample to enter into the observation portion to complete the sample preparation through simple controls.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A sample carrier device for carrying a sample, comprising:

a single substrate, two opposite sides of the substrate being respectively defined as a first side and a second side, and the second side of the substrate being formed with a lower observation window penetrating the substrate;

at least one penetration structure formed on the first side of the substrate, the at least one penetration structure having at least one fluid passage; wherein the lower observation window is configured to expose a part of the at least one penetration structure outside the substrate, and the at least one fluid passage is configured to receive a sample; wherein the at least one penetration structure has a first penetration structure and a second penetration structure, the first penetration structure is formed on the first side of the substrate and has a sheet shape, and the second penetration structure is formed on a surface of the first penetration structure away from the substrate; wherein the second penetration structure includes a top wall and two side walls, the two side walls respectively extend from two opposite sides of the top wall in a direction toward the substrate; wherein the top wall and the two side walls together form the at least one fluid passage with a part of the first penetration structure; wherein a width of the first penetration structure is greater than a width of the second penetration structure in the width direction of the sample carrier device; and a fixing structure formed on a side of the at least one penetration structure opposite to the substrate, and the fixing structure covering a portion of the at least one penetration structure; wherein a side of the fixing structure opposite to the substrate forms an upper observation window penetrating the fixing structure, and the upper observation window is configured to expose a part of the at least one penetration structure outside the fixing structure; wherein the fixing structure has a base portion and a protrusion portion, the base portion is formed on the first penetration structure, the protrusion portion extends from the base portion in a direction away from the substrate, the fixing structure covers and abuts against the top wall and the two side walls, and the protrusion portion has the upper observation window to expose a part of the top wall; wherein a width of the base portion is greater than a width of the protrusion portion in the width direction of the sample carrier device, the width of the first penetration structure is greater than the width of the base portion in the width direction of the sample carrier device, and the width of the protrusion portion is greater than the width of the second penetration structure in the width direction of the sample carrier device; wherein a first stepped structure is formed between the protrusion portion and the base portion, and a second stepped structure is formed between the base portion and the first penetration structure;

wherein the sample carrier device is divided into at least one end portion, at least one operation portion, and an observation portion; the at least one operation portion is located between the at least one end portion and the observation portion, and an external force is adapted to be applied on the at least one operation portion to cause the sample carrier device to be broken off from the at least one operation portion, thereby separating the at least one end portion from the observation portion; the upper observation window and the lower observation window are disposed corresponding to each other, and the upper observation window and the lower observation window are located at the observation portion; and the at least one fluid passage spans across the at least one end portion, the at least one operation portion and the observation portion.

2. The sample carrier device according to claim 1, wherein the sample carrier device is divided into two end portions, two operation portions and an observation portion; the observation portion is located between the two end portions; one of the operation portions is located between one of the end portions and the observation portion; the other one of the operation portions is located between the other one of the end portions and the observation portion; when the two operation portions are operated by the external force and the two end portions are separated from the observation portion least one fluid passage spatially communicates with an external environment, and the sample is capable of entering the at least one fluid passage through and the sample is capable of entering the at least one fluid passage through a port of the at least one fluid passage.

3. The sample carrier device according to claim 1, wherein the portion of the substrate located in the at least one operation portion concavely forms at least one notch, and the portion of the fixing structure located in the at least one operation portion concavely forms at least one notch, and the at least one notch of the substrate corresponds in position to the at least one notch of the fixing structure.

4. The sample carrier device according to claim 1, wherein the portion of the substrate located in the at least one operation portion has at least one modified region, the portion of the fixing structure located in the at least one operation portion has at least one modified region, and the at least one modified region of the substrate corresponds in position to the at least one modified region of the fixing structure.

5. The sample carrier device according to claim 1, further comprising a control module formed in the observation portion, the control module includes a control circuit, a plurality of electrode structures, and a plurality of metal contacts, the metal contacts are electrically connected to the electrode structures, and the metal contacts are electrically connected to the control circuit, the metal contacts are exposed outside the fixing structure, and the electrode structures are located in the at least one fluid passage.

6. The sample carrier device according to claim 1, wherein the sample carrier device is divided into two end portions, and the observation portion is located between the two end portions; wherein one of the end portions forms a microfluidic chip, and the at least one fluid passage is formed in the at least one end portion having the microfluidic chip; wherein the fixing structure is formed on a side of the at least one penetration structure and the microfluidic chip opposite to the substrate, the fixing structure has a plurality of through holes, at least one of the through holes corresponds in position to the microfluidic chip, and the through hole located on the microfluidic chip is configured to expose a part of the at least one penetration structure located at the microfluidic chip, wherein the microfluidic chip includes a mixer, a flow controller, a filter and a switch;

the mixer, the flow controller, the filter, and the switch are disposed in the at least one fluid passage located at the microfluidic chip; when the at least one penetration structure exposed through the through hole located at the microfluidic chip is punctured and the at least one fluid passage communicates with an external environment, the sample is capable of entering the at least one fluid passage through the through hole located at the microfluidic chip, and the sample entering the at least one fluid passage is capable of flowing into the at least one fluid passage located at the observation portion through the mixer, the flow controller, the filter, and the switch.

7. The sample carrier device according to claim 1, wherein the at least one penetration structure and the fixing structure are sequentially formed on the first side of the substrate by a surface micromachining process.

8. A method for operating the sample carrier device according to claim 1, comprising the steps of:

a providing step which includes: providing the sample carrier device according to claim 1;

a disassembling step which includes: separating the at least one end portion from the observation portion to expose two ports of the at least one fluid passage located at the observation portion;

a sampling step which includes: contacting one of the two ports with a sample such that the sample enters the at least one fluid passage through the port; and a sealing step which includes: sealing the two ports to isolate the sample within the at least one fluid passage from an external environment.

* * * * *